US012571535B2

(12) United States Patent
Riga

(10) Patent No.: US 12,571,535 B2
(45) Date of Patent: Mar. 10, 2026

(54) FLAME OUT CANDLE SYSTEM AND METHOD

(71) Applicant: AEXION INC., Roseville, CA (US)

(72) Inventor: John S. Riga, Roseville, CA (US)

(73) Assignee: AEXION INC., Roseville, CA (US)

( * ) Notice: Subject to any disclaimer, the term of this patent is extended or adjusted under 35 U.S.C. 154(b) by 406 days.

(21) Appl. No.: 18/186,620

(22) Filed: Mar. 20, 2023

(65) Prior Publication Data

US 2023/0313991 A1 Oct. 5, 2023

Related U.S. Application Data

(60) Provisional application No. 63/325,194, filed on Mar. 30, 2022.

(51) Int. Cl.
*F23Q 25/00* (2006.01)
*F23D 3/30* (2006.01)

(52) U.S. Cl.
CPC ..... *F23Q 25/00* (2013.01); *F23D 3/30* (2013.01); *F23D 2209/00* (2013.01)

(58) Field of Classification Search
CPC ..... F23D 3/30; F23D 2209/00; F23D 2900/31012; F23D 3/24; F23Q 25/00; C11C 5/00
See application file for complete search history.

(56) References Cited

U.S. PATENT DOCUMENTS

| | | | |
|---|---|---|---|
| 588,140 | A | 8/1897 | Ginder |
| 2,184,666 | A | 12/1939 | Fredericks |
| 4,415,329 | A | 11/1983 | Dodd |
| 5,395,234 | A | 3/1995 | Gutierrez |
| 6,270,339 | B1 | 8/2001 | Zou |
| 6,338,624 | B1 | 1/2002 | Kim |
| 7,217,122 | B1 | 5/2007 | Baird |
| 7,607,916 | B2 | 10/2009 | Almodovar |
| 8,469,701 | B2 | 6/2013 | Quinn et al. |
| 2002/0018976 | A1 | 2/2002 | Zou |
| 2003/0134246 | A1 | 7/2003 | Gray et al. |
| 2005/0110417 | A1 | 5/2005 | Li et al. |

(Continued)

FOREIGN PATENT DOCUMENTS

| | | | |
|---|---|---|---|
| EP | 1241245 | A1 | 9/2002 |
| JP | 57164211 | A | 10/1982 |

(Continued)

*Primary Examiner* — Alfred Basichas
(74) *Attorney, Agent, or Firm* — David Guerra

(57) ABSTRACT

A flame out candle system and method for automatically retracting and extinguishing a wick flame. The system includes a candle, a wick, and a puck assembly. The candle includes a bore to receive the wick, and a cavity to receive the puck assembly. The puck assembly can include a motor driven power screw or spur gears associated with spaced apart pinion gears. The puck assembly is removable from the candle for reuse in another candle. A wick engaging member can be operatively associated with the power screw for linear movement that is transferred to the wick. The pinion gears can be engageable with a rack gear positioned therebetween so rotation of the pinion gears translates into linear motion of the wick. A computer system can be utilized to control the motor based on a time signal, an activation signal, a sensor signal or any wireless signal.

20 Claims, 15 Drawing Sheets

(56) References Cited

U.S. PATENT DOCUMENTS

| | | | | |
|---|---|---|---|---|
| 2017/0268770 | A1* | 9/2017 | White | F23D 3/18 |
| 2018/0106478 | A1 | 4/2018 | Chow | |
| 2022/0228740 | A1* | 7/2022 | Caldwell, Jr. | C11C 5/00 |

FOREIGN PATENT DOCUMENTS

| | | | |
|---|---|---|---|
| JP | 01159508 | A | 6/1989 |
| WO | 8200658 | A1 | 3/1982 |

* cited by examiner

FLAME OUT CANDLE SYSTEM AND METHOD

CROSS-REFERENCE TO RELATED APPLICATION

This application claims the benefit of priority under 35 U.S.C. § 119(e) based upon U.S. provisional patent application Ser. No. 63/325,194 filed on Mar. 30, 2022. The entire disclosure of the prior provisional application is incorporated herein by reference.

BACKGROUND

Technical Field

The present technology relates to a flame out candle system and method for use in connection with retracting a wick into a candle. Further, the present technology can be in connection with automatically retracting a flamed wick into a candle body to extinguish the flame based on a preset time, a preset tilt angle of the candle, a wireless or Bluetooth activation signal, a mobile application (app), a voice command, or an excessive heat signal.

Background Description

Candles have been used as a source of light for thousands of years, and in some cases as a source of heat, yet till this day have posed a considerable safety issue. The earliest use of candles would soak the pithy core of reeds in melted animal fat. Candles have evolved over the years, but the same dangers exist today as they did many years ago. The modern candle still relies on an exposed flame, which must be extinguished by a person or by some other means.

Candles enjoyed renewed popularity in recent years, utilizing byproducts from modern manufacturing in the basic ingredients of candles—paraffin and stearic acid. The ease of manufacturing candles corresponded with their popularity with an interest in candles as decorative items, mood-setters, aromatherapy and gifts. Candles were suddenly available in a broad array of sizes, shapes, colors, and scents.

Candles have come a long way since their initial use. While they are no longer primarily used as a major source of light or heat, they continue to grow in popularity and use. Today, candles can serve to symbolize a celebration, ignite romance, soothe the senses, honor a ceremony, and accent home decors.

However the danger associated with candles remains. With new unstable shapes, candles are prone to tip over leading to increase home fires resulting in property damage, injuries and even death. Further, the modern age has brought a high paced lifestyle to most people resulting in lit candles being left unattended for long periods of time. This can further lead to catastrophic events noted herein.

A dangerous result of using open flamed candles is the possibility of a fire resulting in property damage, injury or death. One of the more common causes of the candle fire hazard is leaving a flamed candle unattended and/or the length of an exposed wick producing a large flame. Longer candle wicks produce a taller flame that will normally burn in an irregular pattern or heights. These irregular patterns create a dangerous propensity for fires. The dangers as it relates to candle wicks, is the possibility of overheating. This results in a significant concern as well as a fire hazard.

In addition, candles come in many different shapes, some of which are very unstable and easy to tip over, unaware to users. It can be appreciated that a tipped over candle poses an extremely dangerous fire hazard.

While known self-extinguishing candle devices fulfill their respective, particular objectives and requirements, the aforementioned devices or systems do not describe a candle with a self-extinguishing flame out candle system and method that allows for automatic retracting of a wick into a candle body utilizing specialized technology, gearing assembly, and computer control systems.

A need exists for new and novel technology causing a candle flame to automatically extinguish. The flame out candle system and method of the present technology which extinguishes the candle flame, fulfills this need. In this respect, the flame out candle system and method according to the present technology substantially departs from the conventional concepts and designs of known self-extinguishing candles, and in doing so provides an apparatus primarily developed for the purpose of retracting a wick into a candle body below the wax line which will extinguish the flame and then make the wick ready to be re-ignited.

SUMMARY

In view of the foregoing disadvantages inherent in known candles of all types, the present technology provides a novel flame out candle system and method, and overcomes one or more of the mentioned disadvantages and drawbacks of known self-extinguishing candles. As such, the general purpose of the present technology, which will be described subsequently in greater detail, is to provide a new and novel flame out candle system and method which has all the advantages of known self-extinguishing candles mentioned heretofore and many novel features that result in a flame out candle system and method which is not anticipated, rendered obvious, suggested, or even implied by known self-extinguishing candles, either alone or in any combination thereof.

According to one aspect, the present technology can include a flame out candle system for retracting a wick into a candle. The flame out candle system can include a puck assembly associated with a candle. The puck assembly can include a motor operatively engageable with a wick engaging member that is operatively engageable with a wick to provide movement of the wick within the candle.

According to another aspect, the present technology can include a flame out candle system including a puck body, a wick engaging member and a base assembly. The puck body can be receivable in a cavity defined in a candle. The puck body can include a guide member, and a bore defined through the guide member. The wick engaging member can be slidably receivable in the bore of the guide member. The wick engaging member can be operatively engageable with a wick. The base assembly can be attachable to the puck body. The base assembly can include a motor operatively engageable with the wick engaging member to provide linear movement of the wick engaging member that provides movement of the wick within the candle.

According to still another aspect, the present technology can include a flame out candle system that can include a candle, a wick, a puck body, a wick engaging member, a base assembly, a motor and a computer or controller system. The candle can include a wick bore defined along a longitudinal axis of the candle, and a bottom cavity defined in a bottom section of the candle and in communication with the wick bore. The wick can be configured to be slidably receivable through the wick bore. A wick plate can be associated with the wick. The puck body can be receivable in the bottom cavity of the candle. The puck body can include a guide member, and a bore defined through the guide member. The wick engaging member can be slidably receivable in the bore of the guide member. The wick engaging member can be operatively engageable with the wick plate. The base assembly can be attachable to the puck body. The base assembly can be configured to support a motor that can be operatively engageable with the wick engaging member to provide linear movement of the wick engaging member that provides movement of the wick within the candle. The computer or controller system can be configured or configurable to control the motor based on one of or any combination of a time signal, an activation signal, a sensor signal, a voice command, a wireless activation signal, and a networked activation signal.

According to yet another aspect, the present technology can include a method of using a flame out candle system to extinguish a wick flame. The method can include the steps of controlling a motor to operatively drive a wick engaging member of a puck assembly associated with the candle. The wick engaging member being operatively engageable with a wick to provide movement of the wick within the candle.

According to yet another aspect, the present technology can include a flame out candle system including a first pinion gear, a second pinion gear, a motor, a rack gear and a wick. The second pinion gear can be spaced apart from the first pinion gear to define a gap therebetween. The motor can be operatively configured to drive the first pinion gear and the second pinion gear so that the first pinion gear and the second pinion gear rotate in opposite directions. The rack gear can be receivable in the gap, and can be engageable with the first pinion gear and the second gear so that rotation of the first pinion gear and the second pinion gear provides linear movement of the rack gear. The wick can be associated with the rack gear for movement therewith through a wick bore defined in a candle.

According to still yet another aspect, the present technology can include a flame out candle system including a candle, a wick assembly, and a puck assembly. The candle can include a wick bore defined along a longitudinal axis of the candle, and a bottom cavity defined in a bottom section of the candle and in communication with the wick bore. The wick assembly can include a wick, a wick plate and a rack gear. The wick can be configured to be slidably receivable through the wick bore. The wick plate can be receivable in the bottom cavity. The rack gear can be attached to the wick plate. The puck assembly can be receivable in the bottom cavity of the candle. The puck assembly can include a first spur gear and a first pinion gear both fixed to a first shaft. A second spur gear and a second pinion both fixed to a second shaft. The second spur gear can be engageable with the first spur gear. The second pinion gear can be spaced apart from the first pinion gear to define a gap therebetween configured to receive the rack gear. A motor can be operatively configured to drive the first spur gear. A computer or controller system can be configured or configurable to control the motor based on one of or any combination of a time signal, an activation signal, a sensor signal, a voice command, a wireless activation signal, and a networked activation signal. The rack gear can be engageable with the first pinion gear and the second gear so that rotation of the first pinion gear and the second pinion gear provides linear movement of the rack gear.

According to yet another aspect, the present technology can include a method of using a flame out candle system to extinguish a wick flame. The method can include the steps of controlling a motor to operatively drive a first pinion and a second pinion gear to linearly move a rack gear engageably positioned therebetween. The rack gear can be configured to provide linear movement to a wick that can be slidably received through a wick bore defined through a candle.

In some or all embodiments, the candle can include a wax body capable of extinguishing a wick flame when the wick is retracting into the wick bore.

In some or all embodiments, the puck assembly can further include a puck body receivable in a cavity defined in the candle, and a base assembly attachable to the puck body and configured to support the motor.

In some or all embodiments, the motor can be operatively associated with one selected from the group consisting of a gear, and a power screw.

In some or all embodiments, the wick engaging member can be configured to be driven by the motor and to provide linear movement to the wick.

In some or all embodiments, the wick engaging member can include a thread member that is operatively engaged with a power screw that is operatively driven by the motor.

In some or all embodiments, the wick engaging member can be slidably received in a bore defined through a guide member of the puck body.

In some or all embodiments, the wick engaging member can further include one or more guides extending out therefrom that are each configured to be slidably received in a channel defined in the guide member and in communication with the bore.

In some or all embodiments, the wick engaging member can include a magnetic that is operatively engageable with a wick plate of the wick.

In some or all embodiments, the puck assembly can further include a candle holder that is receivable in the cavity of the candle and that is configured to receive an insert section of the puck body with a base section of the puck body supporting a bottom portion of the candle.

In some or all embodiments, the candle holder and the insert section can include corresponding engageable elements configured to secure the puck body to the candle holder when the insert section is inserted a predetermined distance into the candle holder.

Some or all embodiments of the present technology can include a first spur gear operatively engageable with a drive gear of the motor. The first spur gear can be fixed to a first shaft that is fixed to the first pinion gear.

Some or all embodiments of the present technology can include a second spur gear operatively engageable with the first spur gear. The second spur gear can be fixed to a second shaft that is fixed to the second pinion gear.

In some or all embodiments, the first pinion gear and the second pinion gear can each include a ledge extending out from a peripheral edge therefrom, respectively. The ledge of the first pinion gear and the ledge of the second pinion gear can be configured to contact the rack gear in an unlocked position.

Some or all embodiments of the present technology can include a wick plate attached to the wick and to the rack gear.

Some or all embodiments of the present technology can include a puck assembly that can include a bottom cover and a top cover. The bottom cover can be configured to support the motor, the first pinion gear and the second pinion gear. The top cover can be attachable to the bottom cover to enclose the motor, the first pinion gear and the second pinion gear.

In some or all embodiments, the bottom cover can further include one or more side locks extending from the bottom cover.

In some or all embodiments, the top cover can include one or more side lock notches configured to receive one or more of the side locks therein when the top cover and the bottom cover are assembled.

Some or all embodiments of the present technology can include a lock bar configured to be receivable in a slot defined in the side locks. The lock bar can be configured to extend exterior of the puck assembly for insertion in to the candle.

In some or all embodiments, the puck assembly can be configured to be securably received in a bottom cavity defined in a bottom section of the candle.

In some or all embodiments, the top cover can include a recessed section defining a top cavity configured to slidably receive the wick plate. A bore can be defined through the recessed section configured to slidably receive the rack gear.

Some or all embodiments of the present technology can include a washer positionable between a top wall of the top cover and a cavity top wall of the candle that defines the bottom cavity.

In some or all embodiments, the puck assembly can further include a U-shaped support structure configured to rotatably support the first shaft and the second shaft, and the first pinion gear and the second pinion gear between parallel side walls that in part defines the U-shaped support structure, with the first spur gear and the second spur gear being located exterior of the parallel side walls.

Some or all embodiments of the present technology can include a computer or controller system configured or configurable to control the motor based on any one of or any combination of a time signal, an activation signal and a sensor signal.

In some or all embodiments, the computer or controller system can be configured or configurable to control the motor based on a sensor selected from the group consisting of a tilt sensor, an angle sensor, and a heat sensor.

Some or all embodiments of the present technology can include a base attachable to the puck assembly and configured to be in electrical communication with electrical components of the puck assembly.

In some or all embodiments, the base can include a metal washer fitted to a top side of the base that is in contact with a bottom side of the candle body.

In some or all embodiments, the base can have a diameter or width greater than a diameter or width of the candle body.

There has thus been outlined, rather broadly, features of the present technology in order that the detailed description thereof that follows may be better understood and in order that the present contribution to the art may be better appreciated.

Numerous objects, features and advantages of the present technology will be readily apparent to those of ordinary skill in the art upon a reading of the following detailed description of the present technology, but nonetheless illustrative, embodiments of the present technology when taken in conjunction with the accompanying drawings.

As such, those skilled in the art will appreciate that the conception, upon which this disclosure is based, may readily be utilized as a basis for the designing of other structures, methods and systems for carrying out the several purposes of the present technology. It is, therefore, that the claims be regarded as including such equivalent constructions insofar as they do not depart from the spirit and scope of the present technology.

It is therefore an object of the present technology to provide a new and novel flame out candle system and method that has all of the advantages of known self-extinguishing candles and none of the disadvantages.

It is another object of the present technology to provide a new and novel flame out candle system and method that may be easily and efficiently manufactured and marketed.

An even further object of the present technology is to provide a new and novel flame out candle system and method that has a low cost of manufacture with regard to both materials and labor, and which accordingly is then susceptible of low prices of sale to the consuming public, thereby making such flame out candle system and method economically available to the buying public.

Still another object of the present technology is to provide a new flame out candle system and method that provides in the apparatuses and methods of the known self-extinguishing candles some of the advantages thereof, while simultaneously overcoming some of the disadvantages normally associated therewith.

These together with other objects of the present technology, along with the various features of novelty that characterize the present technology, are pointed out with particularity in the claims annexed to and forming a part of this disclosure. For a better understanding of the present technology, its operating advantages and the specific objects attained by its uses, reference should be made to the accompanying drawings and descriptive matter in which there are illustrated embodiments of the present technology. Whilst multiple objects of the present technology have been identified herein, it will be understood that the claimed present technology is not limited to meeting most or all of the objects identified and that some embodiments of the present technology may meet only one such object or none at all.

BRIEF DESCRIPTION OF THE DRAWINGS

The present technology will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE EMBODIMENTS

Figure 1:
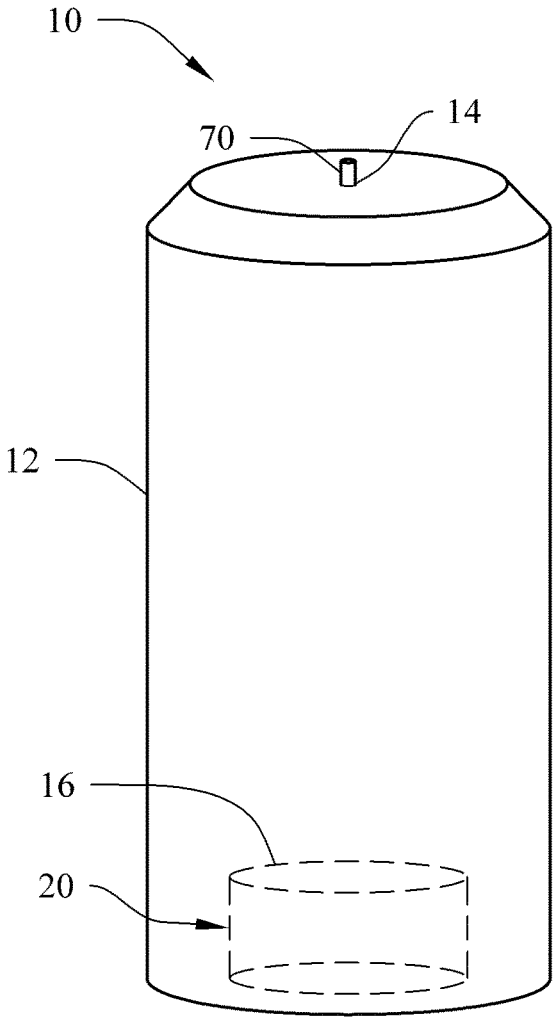
FIG. 1 is a top perspective view of an embodiment of the flame out candle system constructed in accordance with the principles of the present technology, with the hidden (dashed) lines depicting internal structure.

In the following description, for purposes of explanation and not limitation, specific details are set forth, such as particular embodiments, procedures, techniques, etc. in order to provide a thorough understanding of the present technology. However, it will be apparent to one skilled in the art that the present technology may be practiced in other embodiments that depart from these specific details.

Referring now to the drawings, and particularly to FIGS. 1-28, an embodiment of the flame out candle system and method of the present technology is shown and generally designated by the reference numeral 10. According to any aspect, the present technology can include a flame out candle system for retracting a wick into a candle. The flame out candle system can include a puck assembly associated with the candle body. The puck assembly can include a motor operatively engageable with a wick engaging member that is operatively engageable with a wick to provide movement of the wick within the candle.

It can be appreciated that the puck assembly in any or all embodiments of the present technology can be a separate or standalone component utilizable in any type of candle. It can further be appreciated that the puck assembly in any or all embodiments of the present technology can have any size, configuration and/or shape capable of being utilized with various other candle designs.

The design of any or all embodiments of the puck assembly of the present technology, including structure, utility and/or function, is protected in any subsequent iteration regardless of the application.

Figure 2:
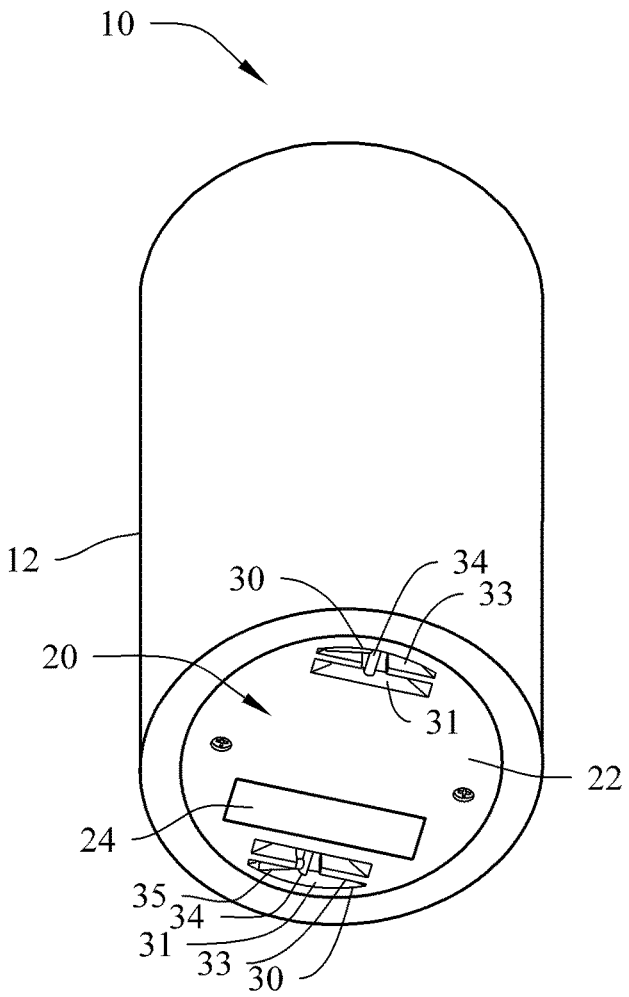
FIG. 2 is a bottom perspective view of the flame out candle system of the present technology.

In FIGS. 1 and 2, and in the exemplary, a new and novel flame out candle system and method 10 of the present technology for retracting a wick 70 into a candle or candle body 12 is illustrated and will be described. More particularly, the flame out candle system and method 10 can include the candle body 12 including a wick bore 14, a wick 70, and a puck assembly 20 receivable in a bottom cavity 16 of the candle body 12. The flame out candle system 10 can be utilized and configured to automatically retract the wick 70 into the candle body 12 after a predetermined time period from a timer, upon activation of an input by a user, upon activation by voice command, upon wireless or Bluetooth activation, networked or internet activation or a sensor such as, but not limited to, a tilt/angle sensor 208, a motion sensor or a heat sensor 218 (see FIG. 28). The tilt/angle sensor 208 can be in the form of a mercury switch with a horizontal orientation being configured as a non-activation state.

The candle body 12 can be any type of candle or the like such as, but not limited to, a wax candle, a glass jar candle, an oil lamp, any candle including burnable body, or any lamp utilizing a burnable fuel. In the exemplary and without limitation, the following description will reference a wax candle. The present technology can be adapted to any size or shape candle or can be retrofitted into existing candles.

The wick bore 14 can be defined along a central longitudinal axis of the candle body 12 in communication with the bottom cavity 16, thereby corresponding with known candle designs. However, it can be appreciated that the wick bore 14 can be a plurality of bores defined through the candle in any location, direction angle and/or orientation so as to accommodate multiple wicks at varying locations and directions.

The wick 70 can slidably travel through the wick bore 14 of the candle body 12 can extend into the bottom cavity 16. The wick 70 can be designed to slide or move freely through the wick bore 14 by way of a nonstick or lubricant coating on the wick 70. In the alternative, the wick 70 can be placed in a hollow shaft or tube (not shown) allowing the wick 70 to move freely through the wick bore 14.

The puck assembly 20 can be utilized and configured to include all the mechanical and electrical components for operation of the present technology. The puck assembly 20 can be designed so that it fits snugly into the bottom cavity 16 of the candle body 12, while not falling out unless physically removed. In the exemplary, structural retentions means can be associated with an exterior of the puck assembly 20 that engages with the wax material of the candle body 12 that defines the bottom cavity 16, thereby securing the puck assembly 20 in the bottom cavity 16. The puck assembly 20 can be inserted into a hardened wax candle or it can be placed in a candle mold for receipt of molten wax around the puck assembly 20. Upon hardening, the wax would then solidify around the puck assembly 20 thereby securing it place.

Figure 3:
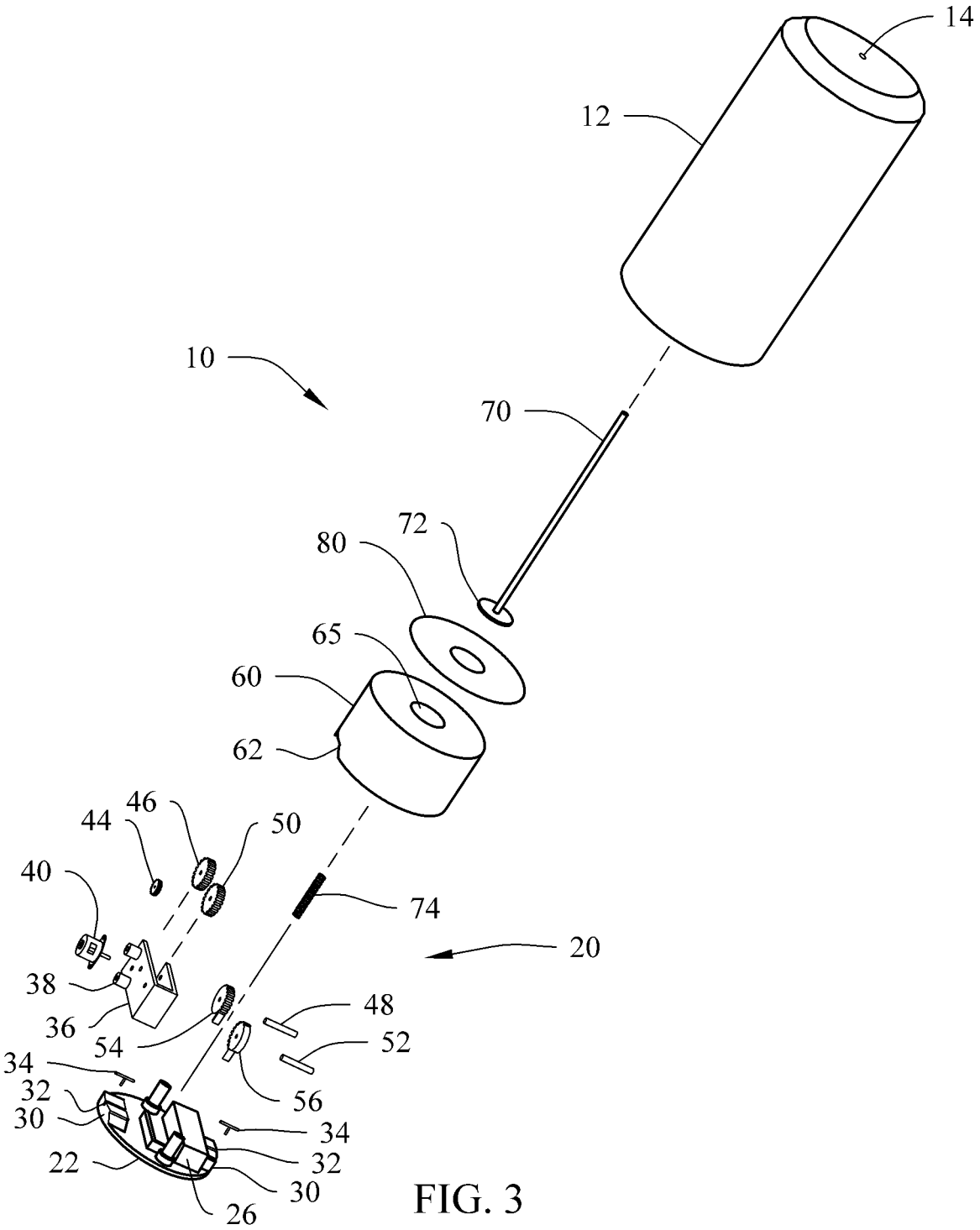
FIG. 3 is an exploded perspective view of the flame out candle system of the present technology.

With reference to FIG. 3, the present technology can utilize the puck assembly 20 to slidably move a wick 70 through the wick bore 14 of the candle body 12. The puck assembly 20 can include a base assembly or bottom cover 22 and a puck body or top cover 60 secured together to form a closable body that encloses the mechanical and electrical components of the present technology. The puck body can have, but not limited to, a substantially cylindrical configuration that is shaped to correspond with the bottom cavity 16 of the candle.

The bottom cover 22 can include a battery cover 24 giving access to one or more batteries 26, as best illustrated in FIGS. 2-5. One or more side locks 30 can extend up from opposite sides of a perimeter edge of the bottom cover 22. Each side lock 30 can include a slot 32 configured to receive a lock bar 34 having, but not limited to, a generally T-shape. Each side lock 30 is receivable in a side lock notch 62 defined in a perimeter edge of the top cover 60.

Figure 7:
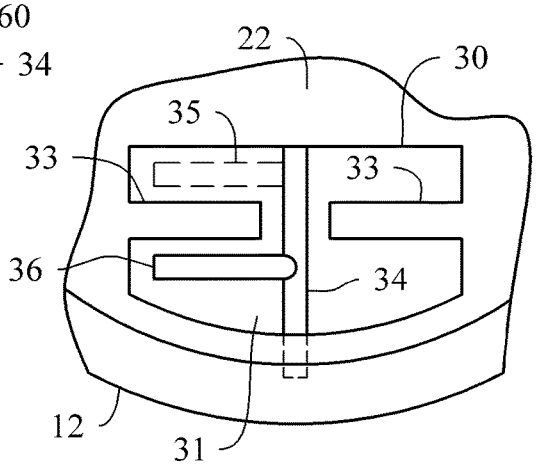
FIG. 7 is a bottom elevational view showing the lock bar in an engaged position inserted into the candle and a disengaged position retracted from the candle, with the grip portion rotated in a stow away position in the open bottom recess of the slide lock.
Figure 8:
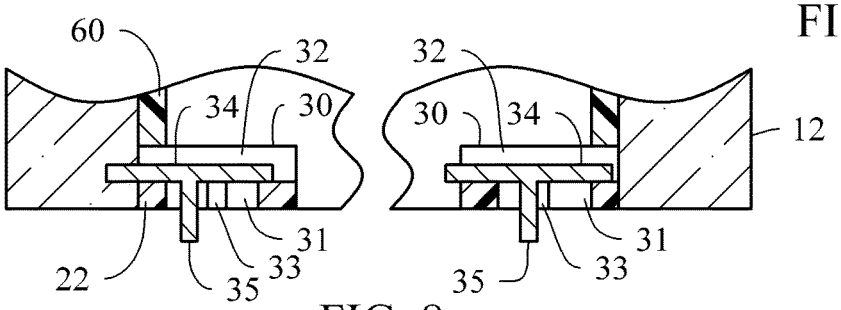
FIG. 8 is a cross-sectional view showing a left side lock bar in the engaged position and a right side lock bar in the disengaged position.

As best illustrated in FIGS. 7 and 8 and in the exemplary, a portion of the T-shaped lock bar 34 can extend out from the side lock 30 and the bottom cover 22 so a user can slide the lock bar 34 along the slot 32 so a free end of the lock bar 34 can extend out from the slot 32 being a side of the puck assembly 20 for insertion into the candle body 12. This can be accomplished by the slide lock 30 including an open bottom recess 31 in communication with the slot 32 with side walls of the side lock 30 support end sections of the T-shaped lock bar 34. The open bottom recess 31 is divided into two or more sections by a pair of dividing walls 33 defining an opening between their free ends allowing a grip portion 35 of the lock bar 34 to travel therebetween. After insertion, the user can rotate the lock bar 34 so that the grip portion 35 is received in any one of the sections of the open bottom recess 31.

To disengage the lock bar 34 from the candle body 12 allowing the puck assembly 20 to be removed, the user can rotate the grip portion 35 out from the open bottom recess 31 and slide the lock bar 34 along the slot 32 to a retracted position.

Figure 4:
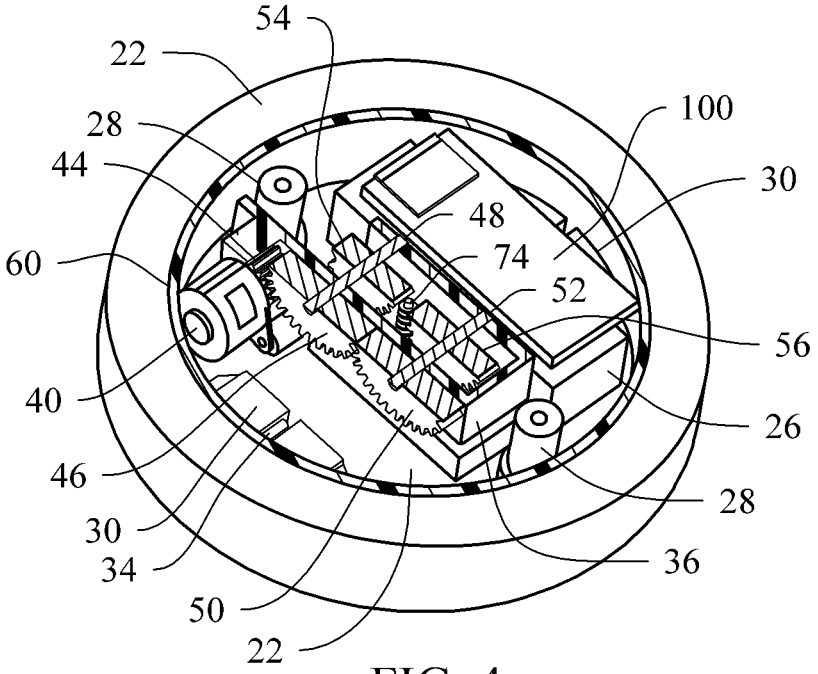
FIG. 4 is a cross-sectional perspective view of the puck assembly of the present technology.
Figure 9:
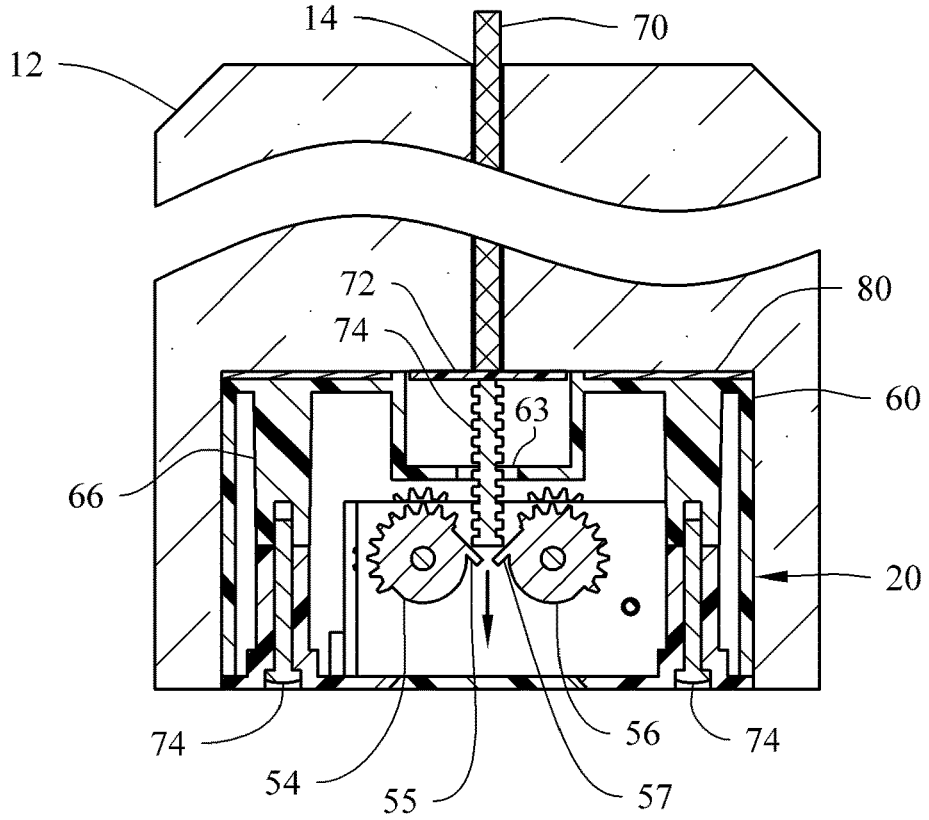
FIG. 9 is a cross-sectional view of the wick engaging gear assembly, the wick and the plate in the unlocked position.

One or more mounting posts 28 can extending up from the bottom cover 22 that can mate or abut corresponding mounting posts 66 extending from a top wall of the top cover 60, as best illustrated in FIGS. 4 and 9. Fasteners 78 can be utilized to secure the bottom cover 22 and the top cover 60 together, as best illustrated in FIG. 9.

In an alternative, a threading arrangement can be associated with the bottom cover 22 and the side wall of the top cover 60 to allow rotational assembling of the puck assembly 20, thereby omitting the mounting posts 28, 66.

Referring to FIGS. 3-6, the bottom cover 22 can include a drive supporting structure 36 including a generally U-shaped wall. From one side wall of the drive supporting structure 36 can extend one or more motor mounts 38. A motor 40 can include one or more motor flanges 42 configured to align with the motor mounts 38 thereby allowing the motor 40 to be secured to the drive supporting structure 36 in a horizontal position or parallel with the bottom cover 22 or lateral with the drive supporting structure 36. A drive gear 44 is operatively engaged with the motor 40, and when assembled, the motor 40 and drive gear 44 are located on an exterior side of the drive supporting structure 36 by way of the motor mounts 38.

A first spur gear 46 is rotatably mounted on the exterior side of the drive supporting structure 36 by way of a first shaft 48 extending through parallel walls of the U-shaped drive supporting structure 36. The first spur gear 46 is engageable and operatively driven by the drive gear 44.

Figure 5:
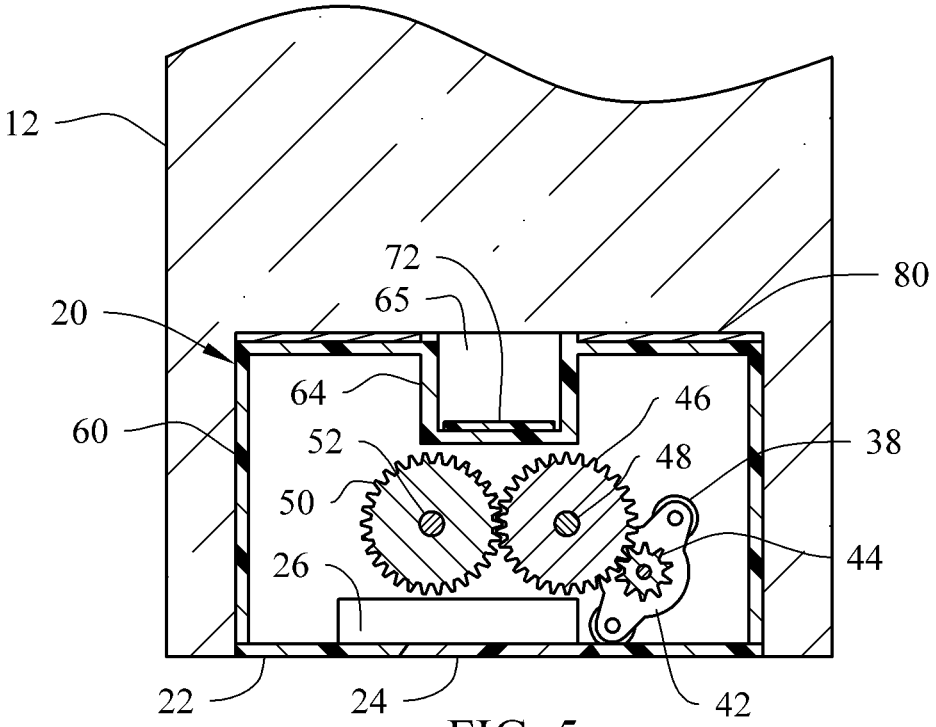
FIG. 5 is a cross-sectional view of the motor and gear assembly of the present technology.
Figure 6:
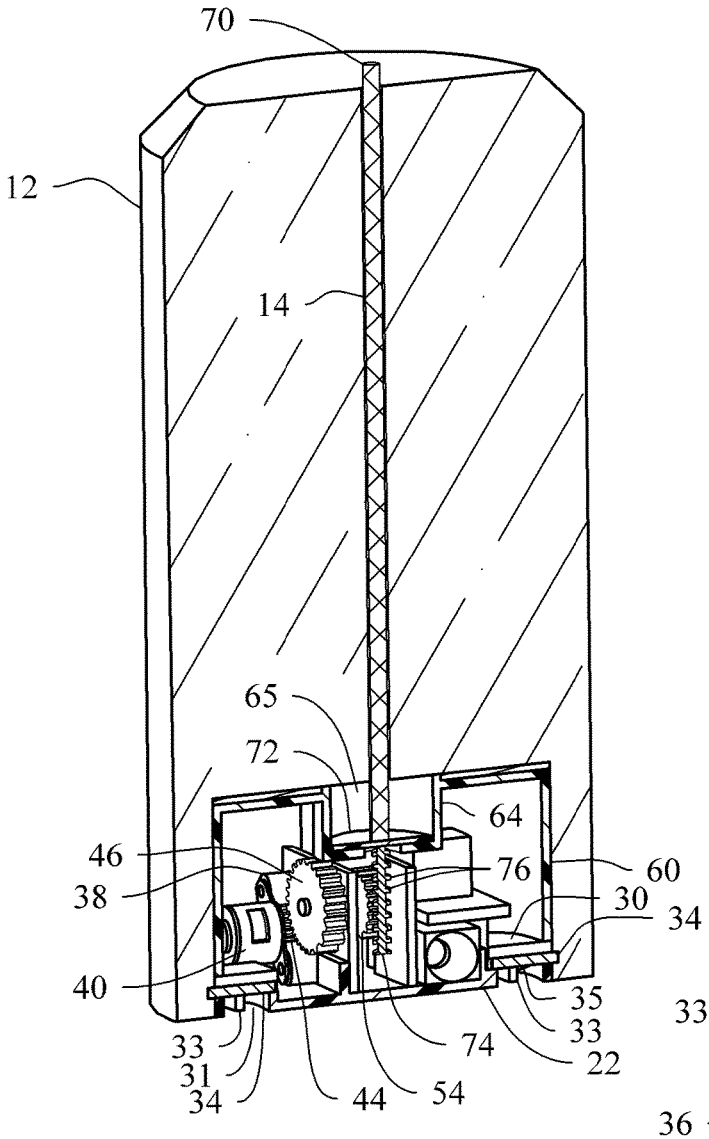
FIG. 6 is a cross-sectional perspective view of the flame out candle system of the present technology.

A second spur gear 50 is rotatably mounted on the exterior side of the drive supporting structure 36 by way of a second shaft 52 extending through parallel walls of the U-shaped drive supporting structure 36. The second shaft 52 and thus the second spur gear 50 are in a spaced apart relationship with the first spur gear 46. The second spur gear 50 is engageable and operatively driven by the first spur gear 46. As best illustrated in FIG. 5, when in operation the motor 40 rotates the drive gear 44 which rotates the first spur gear 46 with thus counter rotates the second spur gear 50.

Inside the U-shaped drive supporting structure 36 can be located a wick engaging member or assembly that can feature a clamping gear assembly or a rack and pinion assembly including a first pinion gear 54, a second pinion gear 56 and a cylindrical-like rack gear 74, as best illustrated in FIGS. 4, 6 and 9-11. The first pinion gear 54 is operatively mounted with the first shaft 48 for rotation along with rotate of the first spur gear 46. The second pinion gear 56 is operatively mounted with the second shaft 52 for rotation along with rotate of the second spur gear 50. The first pinion gear 54 and the second pinion gear 56 have a size or diameter less than there corresponding spur gear. This provides a gap or spacing between the teeth of the first and second pinion gears 54, 56.

The first and second pinion gears 54, 56 each include a toothed section, an untoothed section and a protruding ledge 55, 57, respectively. The protruding ledge 55, 57 extends tangentially from an edge of their corresponding pinion gears 54, 56. When assembled, the ledges 55, 57 are facing each other when the present technology is in an unlocked position, as best illustrated in FIG. 9. Flat surfaces or defined on the ledges 55, 57 to provide a smooth contacting point with the free end of the rack gear 74, allowing the ledges 55, 57 to be easily radially pushed upon contact by the rack gear 74.

The rack gear 74 can be configured as an elongated shaft featuring multiple offset radial or cylindrical teeth 76. The rack gear 74 is further configured to be receivable in the gap between the first and second pinion gears 54, 56 so that the cylindrical teeth 76 are engageable with the teeth of the first and second pinion gears 54, 56. It can be appreciated that rotation of the first and second pinion gears 54, 56 translates into longitudinal movement of the rack gear 74.

Accordingly, continued pushing of the rack gear 74 against the ledges 55, 57 results in rotation of the first and second pinion gears 54, 56 until the teeth 76 of the rack gear 74 are engaged with teeth of each of the first and second pinion gears 54, 56. It can be appreciated that pulling of the rack gear 74 would reverse rotation of the first and second pinion gears 54, 56 until the teeth 76 of the rack gear 74 or withdrawn or disengaged with teeth of the first and second spur gears 46, 50.

A computer or controller system 200 can be included with the puck assembly 20 and can be associated with the bottom cover 22 in operable communication with the battery 26 and the motor 40. The computer or controller system 200 can include and/or be in communication with a variety electrical components, sensors, controllers, and the like. For example, the computer or controller system 200 can include a printed circuit board (PCB) featuring a timer and/or an angle or tile sensor 208 configured to detect or determine a tilting or tipping orientation of the candle body 12 or a wireless, internet or Bluetooth interface.

The top cover 60, as best illustrated in FIGS. 5, 6 and 9-11, can include a guide member or recessed section 64 defining a bore or top cavity 65 configured to slidably receive a wick plate 72. The interior of the top cover 60 can include hollow section with an open end configured to enclose the electrical and mechanical components of the puck assembly 20. A seal or gasket (not shown) can be associated with a free end or edge of the side wall of the top cover 60 to prevent wax or moisture from entering the interior of the puck assembly 20 when the bottom cover 22 and the top cover 60 are assembled.

The wick plate 72 is configured to support and be fixed to a free end or end section of the wick 70, in combination with being fixed to or engaged with a free end of the rack gear 74. A bottom wall of the recessed section 64 defines a bore 63 therethrough that is in communication with the top cavity 65. The bore 63 is configured to slidably receive therethrough the rack gear 74, as best illustrated in FIG. 9. It can be appreciated that movement of the rack gear 74 translates into movement of the wick plate 72 and consequently the wick 70.

A metal washer 80 can be positioned between a top wall of the top cover 60 and a cavity top wall of the bottom cavity 16 of the candle body 12. The metal washer 80 can be configured to protect the puck assembly 20 from melting wax from the candle body 12 during operation.

Figure 10:
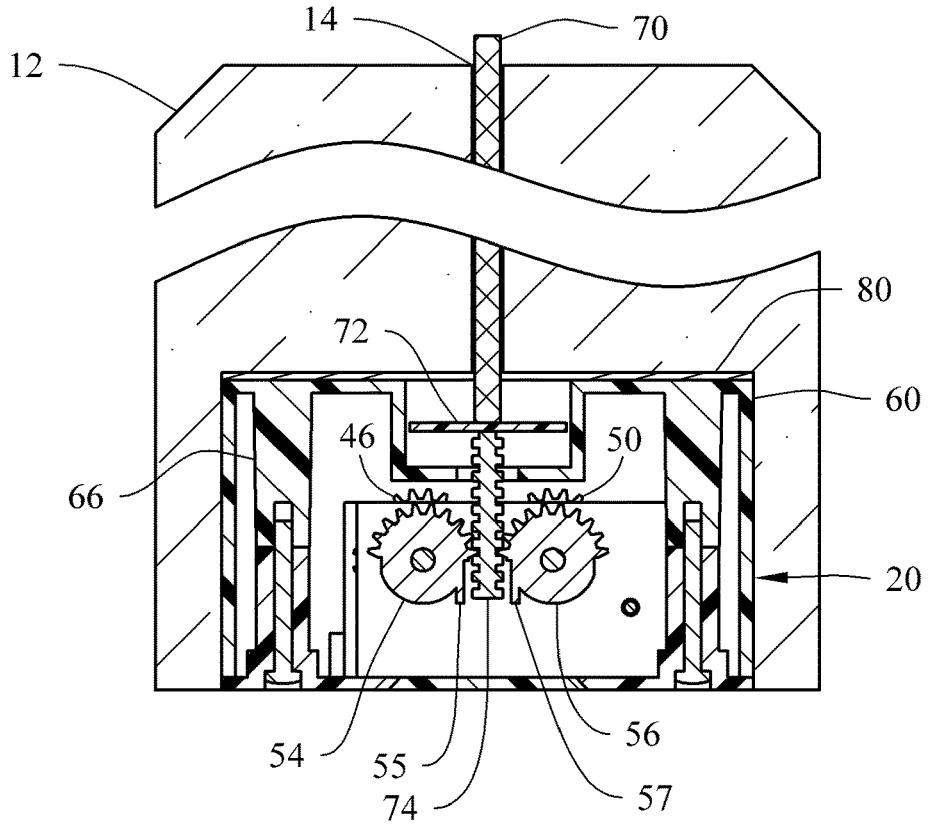
FIG. 10 is a cross-sectional view of the wick engaging gear assembly in the engaged position with the wick and the wick plate pushed down.
Figure 11:
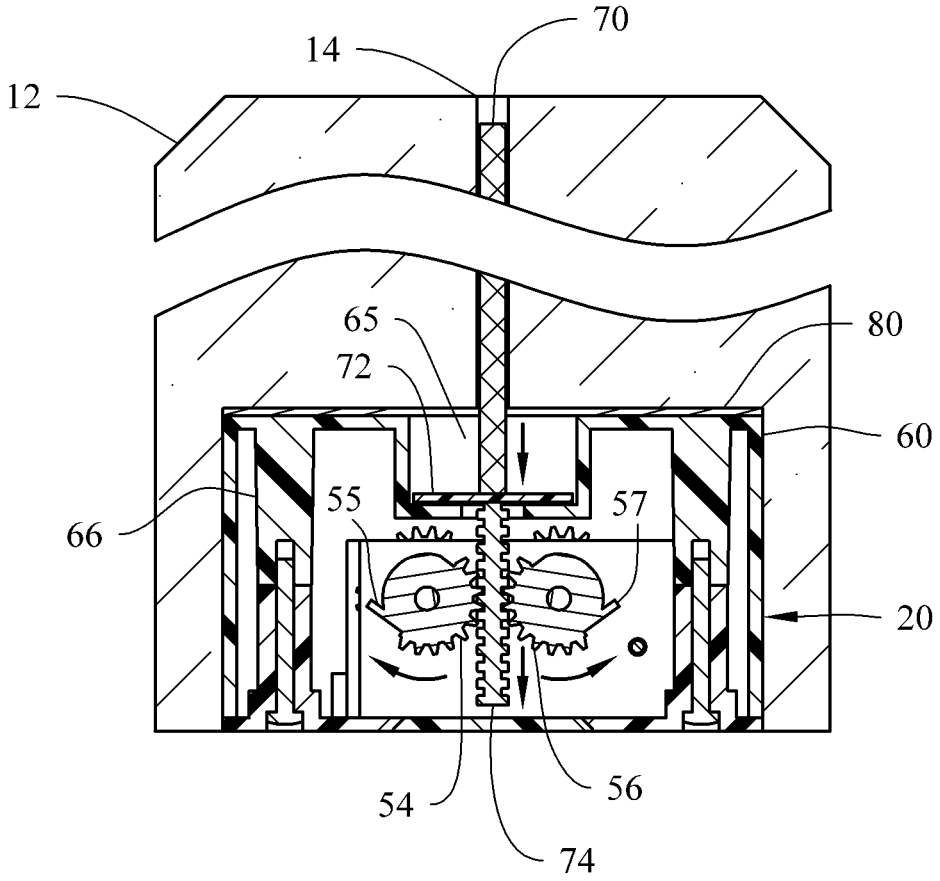
FIG. 11 is a cross-sectional view of the wick engaging gear assembly in the retracted position with the wick retracted into the candle body.

Referring now to FIGS. 9-11, the operational aspect associated with movement of the wick 70 will be described. Initially, the first and second pinion gears 54, 56 can be in an unlocked position (see FIG. 9) thus allowing the free motion of wick 70. In the unlocked position the ledge 55, 57 of the first and second pinion gears 54, 56 are facing each other so that a flat surface of the ledge 55, 57 are capable of being in contact a free end of the rack gear 74. The rack gear 74, the wick 70 and the wick plate 72 can be inserted into the top cavity 65 so that the rack gear 74 extending through the bore 63 and into the gap between the first and second pinion gears 54, 56 so that the free end of the rack gear 74 contacts both ledges 55, 57.

After which, the wick plate 72 can be pushed slightly into the top cavity 65 so the rack gear 74 pushes against the ledges 55, 57 thereby rotating their corresponding pinion gears 54, 56 so that their teeth engage with the cylindrical teeth 76. This now results in the first and second pinion gears 54, 56 being in a locked position, as best illustrated in FIG. 10.

Accordingly, operation of the motor 40 will now result in rotation of the first and second spur gears 46, 50, which results in rotation of the first and second pinion gears 54, 56, with thus results in longitudinal movement of the rack gear 74 and wick 70.

In an extinguishing operation, the motor 40 can be operated so the first and second pinion gears 54, 56 are in a retracted position, as best illustrated in FIG. 11. In the retracted position, the wick 70 is retracted into the candle body 12 where melted wax can extinguish the flame of the wick 70. In the exemplary, rotation of the first and second pinion gears 54, 56 can be through a particular angle that will allow vertical motion of the wick 70 approximately ½ of an inch. It can be appreciated that reverse operation of the motor 40 can result in the wick 70 being extending up and out of the wick bore 14 ready for ignition and use.

Operation of the motor 40 can be accomplished by a button located on the bottom cover 22 or automatically by the computer or controller system 200. Further in the exemplary, the bottom cover 22 can include one or more buttons or switches for providing control or setting control of the motor 40 and/or the computer or controller system 200. For example, the buttons and/or switches can be associated with one or more operational aspects, but not limited to, ON/OFF, Test mode, preset time periods for automatic retraction of the wick 70 (10 minutes, 30 minutes, 1 hour, 2 hours, 3 hours, 4 hours, etc.), clamp wick mode and unclamp wick mode, or remove puck. The Test mode can be configured to allow the candle body 12 to burn for a predetermined amount of time (TBD), then operate the motor 40 to retract the wick 70 and extinguish the flame and remain unlit until the user re-lights it. The clamp wick mode can be configured to lock the wick 70 to the puck assembly 20, while the unclamp wick mode can be configured to unlock the wick 70 from the puck assembly 20. The remove puck switch can be configured to allow removal of the puck assembly 20 from the candle body 12 without damage to the motor and gear assembly. It can be appreciated that the switches or buttons can be of any known type.

Figure 12:
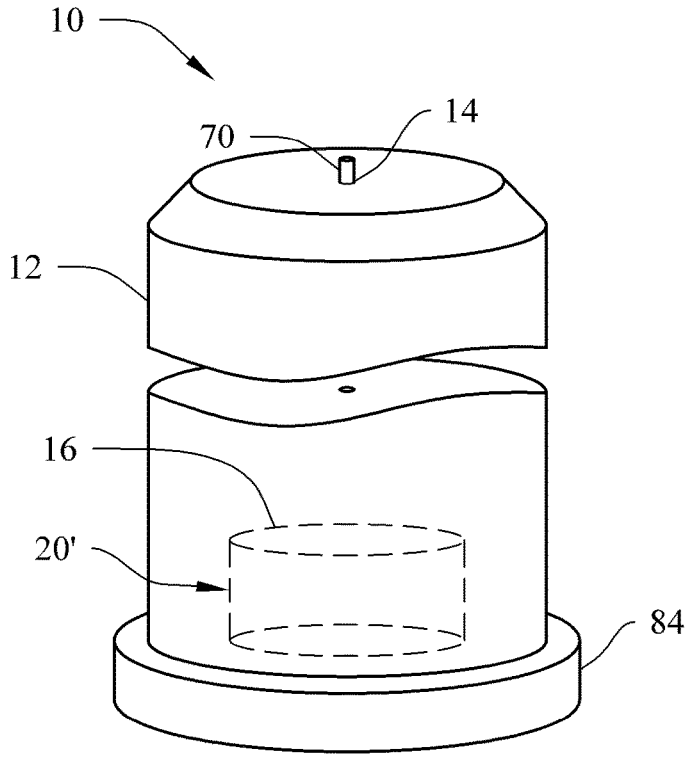
FIG. 12 is a perspective view of the flame out candle system including the puck base with the puck assembly attached thereto and inserted in the candle body.
Figure 13:
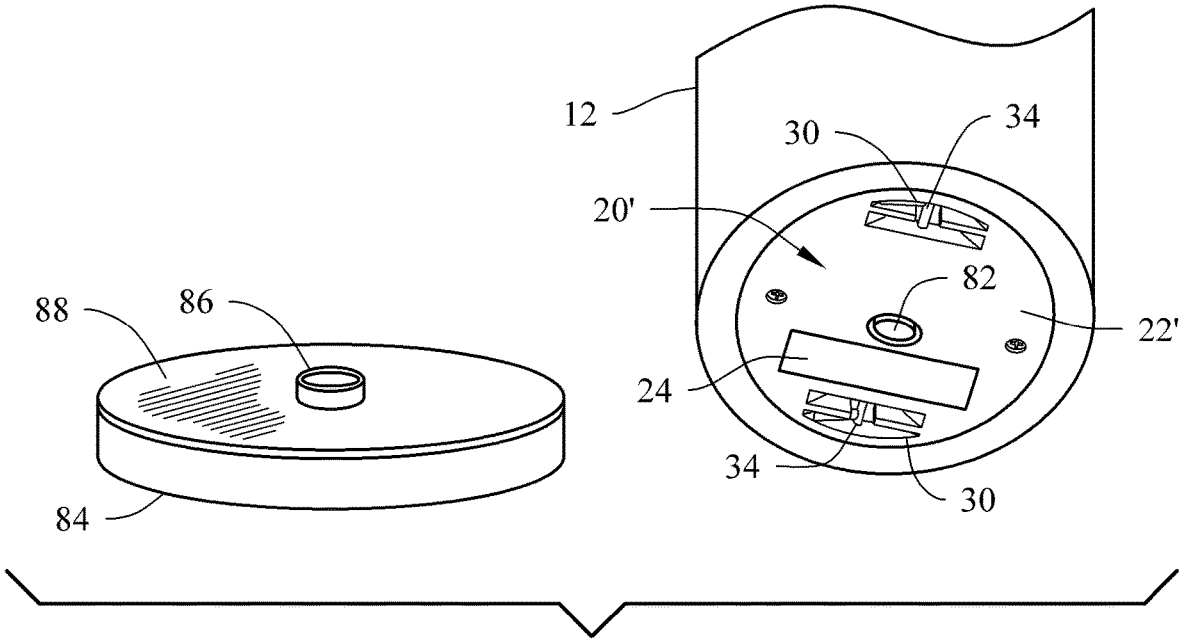
FIG. 13 is an exploded perspective view of a bottom section of the puck assembly showing the puck connector and a top section of the puck base showing the base connector.

Referring now to FIGS. 12 and 13, an alternate embodiment of the puck assembly 20' include a puck base 84 can be utilized with the present technology. The puck base 84 can be configured to operable connect to and/or with the puck assembly 20'. The puck base 84 can have any geometrical configuration to support the candle body 12, and can have a width or diameter greater than that of the candle body 12. It can be appreciated that the puck base 84 can be configured to catch any melting wax that runs down the side of the candle body 12. It can further be appreciated that the puck base 84 can be included and/or purchased together or separately with the candle body 12 and/or the puck assembly 20'.

In the exemplary, the puck base 84 can be a decretive flat base approximately ¾ inches tall, round like the bottom of the candle body 12 and approximately 1 or 2 inches wider than the candle body 12.

The puck base 84 can be configured to carry some or all the electronic components and a battery that may not fit in the puck assembly 20'. The battery in the puck base 84 can be the main power supply or supplemental to the battery in the puck assembly 20'. Alternatively, power can be provided to the puck base 84 and/or the puck assembly 20, 20' by a power cord and appreciate power conversion that can be plugged into a standard electrical outlet. Such electronic components can be, but not limited to, a wireless receiver or transceiver, a Bluetooth or electronic interface, a microphone for voice command or recognition, and the like.

The puck assembly 20' and the puck base 84 can be connected or mated together by way of a male/female connector or some electronic interface operatively connecting the two units to work as one. In the exemplary, the puck assembly 20' can include a female connector 82 including appropriate electrical contacts that correspond with a male connector 86 of the puck base 84, and respectively vice versa. The male and female connectors 82, 86 can have a cylindrical configuration allowing the puck assembly 20' to rotation in relation with the puck base 84.

A metal top plate 88 can be placed on a top side of the puck base 84 to not allow hot wax from damaging the top of the puck base 84. The top place 88 can be in the shape of a washer and removably placed on the top side of the puck base 84 with the male connector 86 extending through a central hole in the top plate 88.

Figure 14:
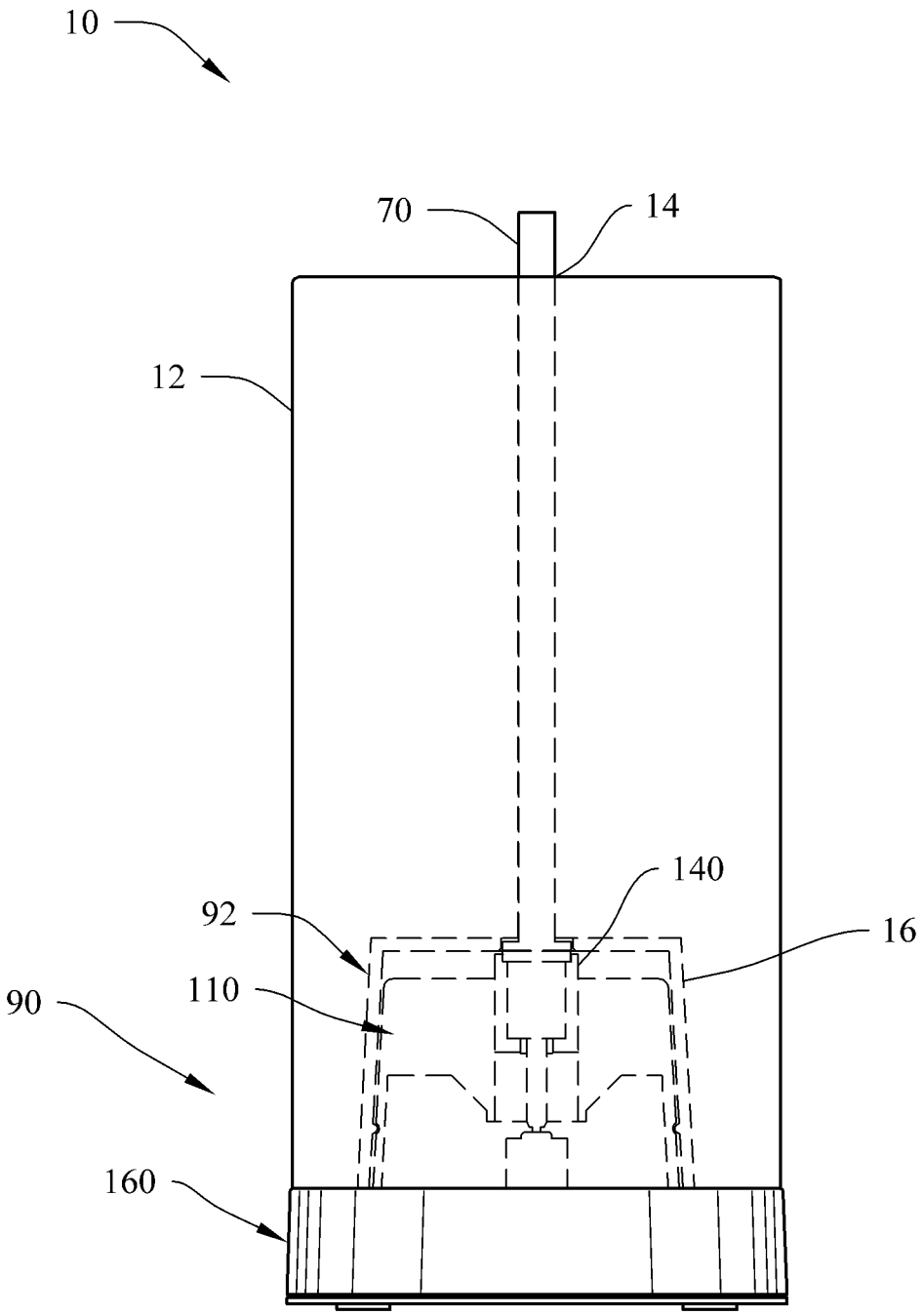
FIG. 14 is a perspective view of the flame out candle system including an alternate embodiment puck assembly inserted in the candle body including the puck base, the puck body the candle holder and the wick drive member.

Referring to FIGS. 14-27, the novel flame out candle system 10 of the present technology can include an alternate embodiment puck assembly 90 for retracting the wick 70 into the candle body 12. More particularly, the puck assembly 90 can be receivable in the bottom cavity 16 of the candle body 12, and can include a candle holder 92, a puck body 110, a wick engaging member 140 and a puck base assembly 160, as best illustrated in FIG. 14. The puck assembly 90 can be utilized and configured to include all the mechanical and electrical components for operation of the present technology. The puck assembly 20 can be designed so that it fits snugly into the bottom cavity 16 of the candle body 12, while not falling out unless physically removed.

Figure 28:
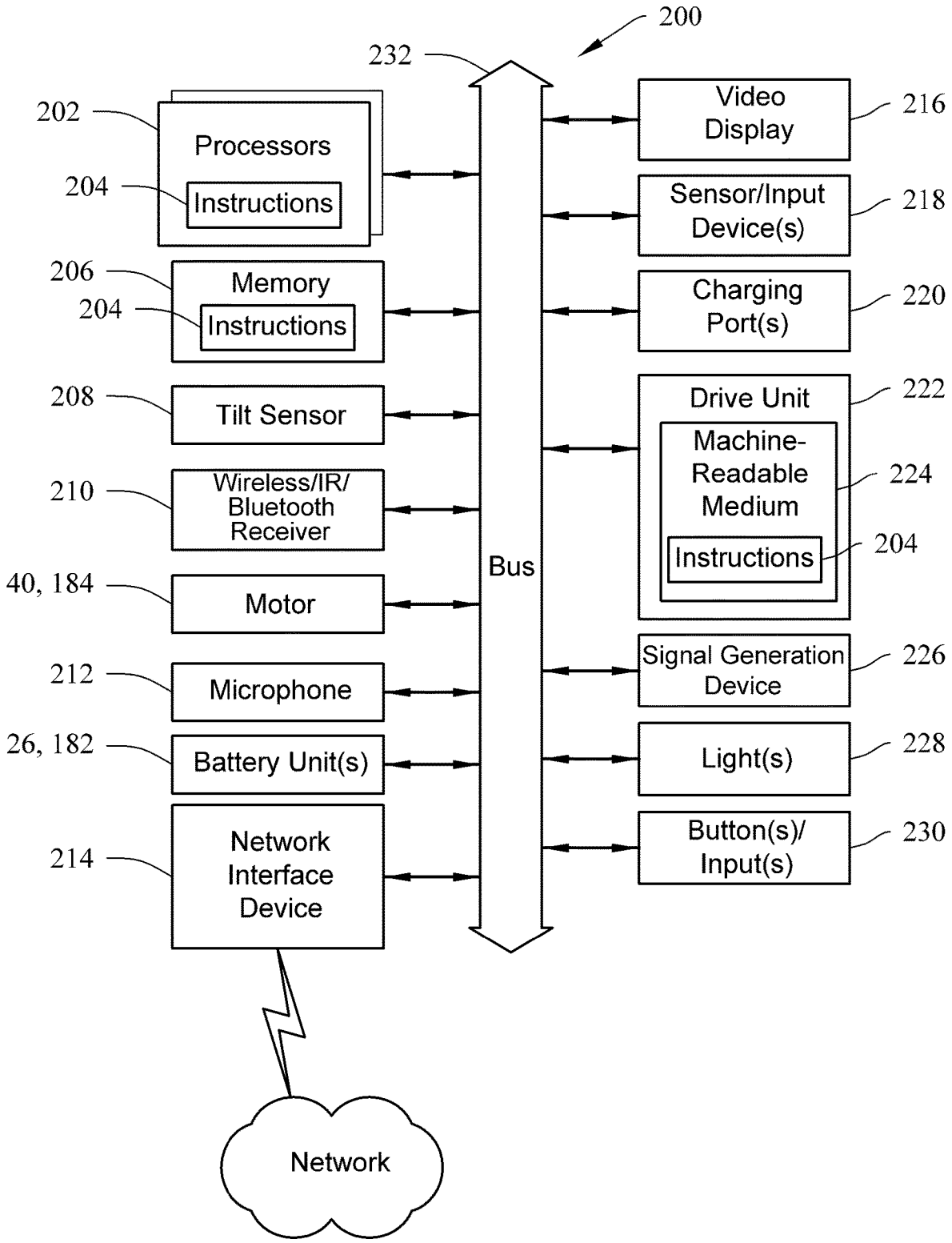
FIG. 28 illustrates an exemplary electronic computing device that may be used to implement an embodiment of the present technology.

The flame out candle system 10 can be utilized and configured to automatically retract the wick 70 into the candle body 12 after a predetermined time period from a timer, upon activation of an input by a user, upon activation by voice command, upon wireless or Bluetooth activation, networked or internet activation or a sensor such as, but not limited to, the tilt/angle sensor 208, the motion sensor 218, or the heat sensor 218 (see FIG. 28). The tilt/angle sensor 208 can be in the form of a mercury switch with a horizontal orientation being configured as a non-activation state.

Figure 15:
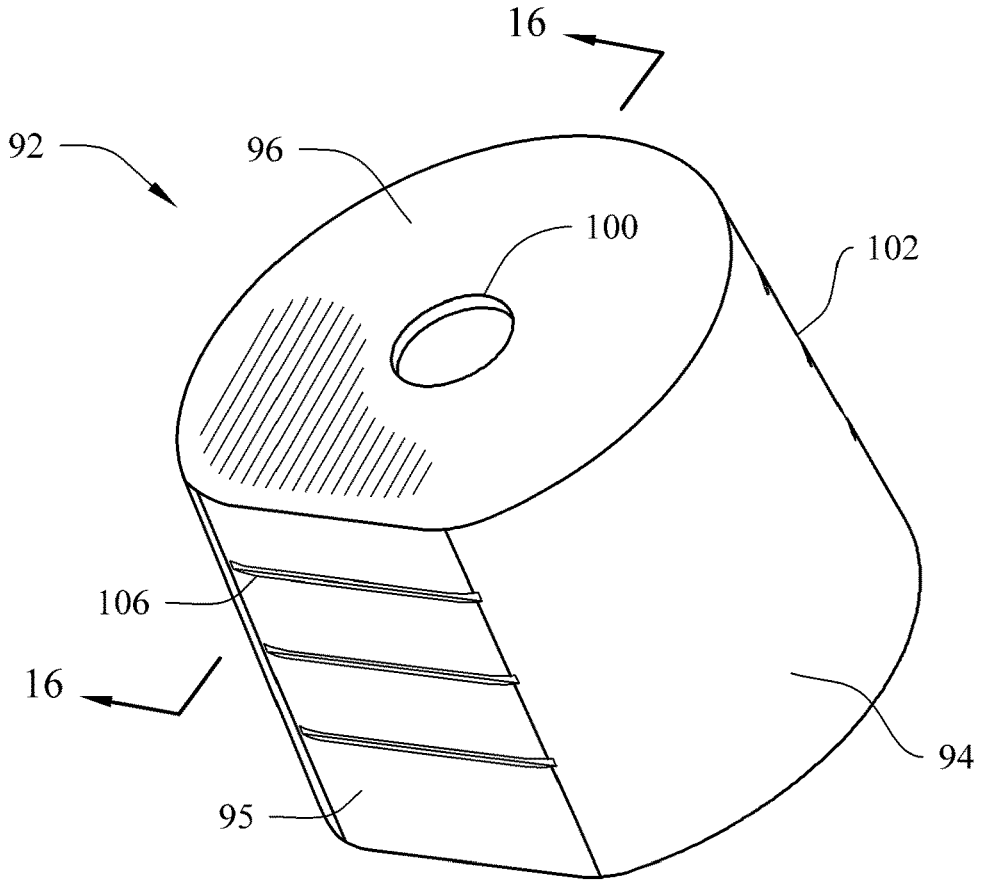
FIG. 15 is a perspective view of the candle holder of the alternate embodiment puck assembly.
Figure 16:
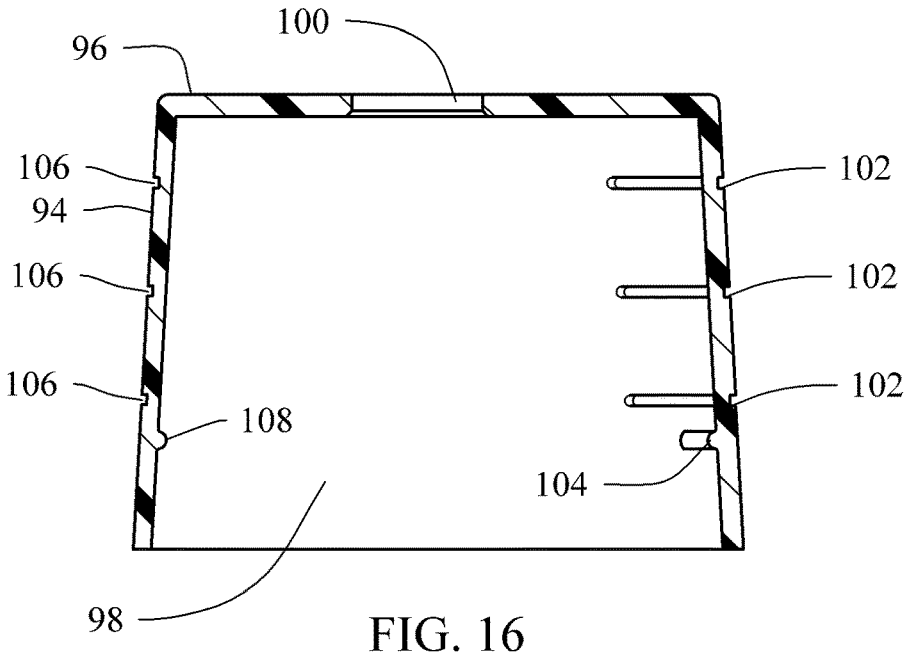
FIG. 16 is a cross-sectional view of the candle holder taken along line 16-16 in FIG. 15.

Referring to FIGS. 15 and 16, the candle holder 92 is receivable and securable in the bottom cavity 16 of the candle body 12, and can include a body 94 featuring a top wall 96, a candle holder interior chamber 98 and an open bottom. An opening 100 is defined through the top wall 96 and is in communication with the interior chamber 98. The opening 100 is configured to receive therethrough the wick 70 and the wick plate 72 that can be made of metal or any ferromagnetic material.

In the exemplary, the candle holder body 94 can be substantially cylindrical with an outwardly tapering shape from the top wall 96. The body 94 can include a substantially flat or planar side 95. One or more first grooves 102 can be defined in or through a first section of the body 94, and one or more first ridges 104 can extend from an interior side of the body 94 into the interior chamber 68.

One or more second grooves 106 can be define din or through the planar side 95, and one or more second ridges 108 can extend from an interior side of the planar side 95 of the body 94 into the interior chamber 68.

It can be appreciated that the body 94 can be any geometrical shape, and the first and second grooves 102, 106 and the first and second ridges 104, 108 can have any configuration or profile.

In the exemplary, the first and second grooves 102, 106 can act as structural retentions means associated with an exterior of the candle holder 92 that engages with the wax material of the candle body 12 that defines the bottom cavity 16, thereby securing the candle holder 92 in the bottom cavity 16. The candle holder 92 can be inserted into a hardened wax candle or it can be placed in a candle mold for receipt of molten wax around the candle holder 92. Upon hardening, the wax would then solidify around the candle holder 92 and into the grooves 102, 106 thereby securing it in place in the cavity 16.

Figure 17:
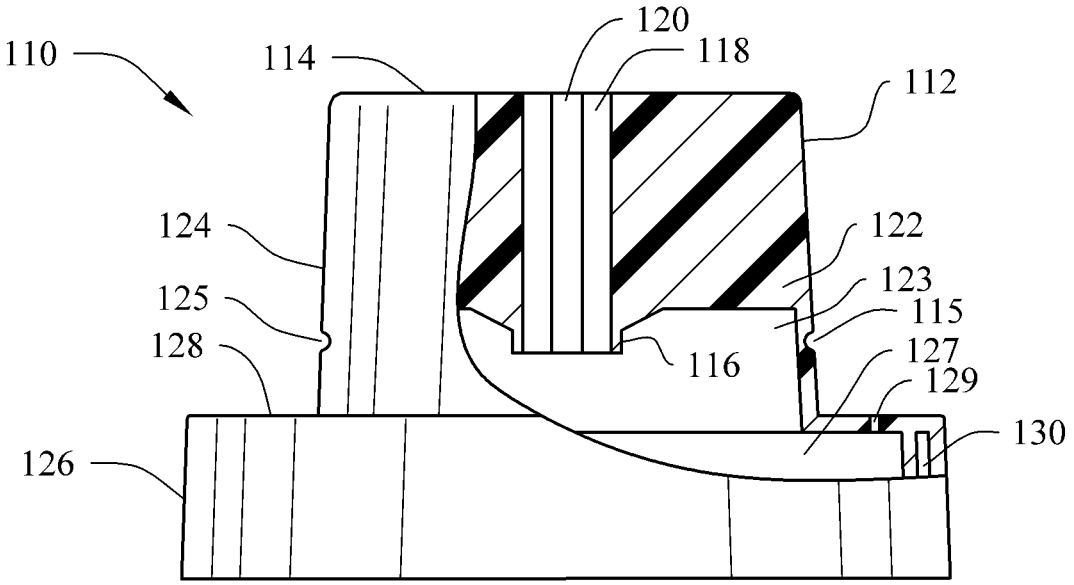
FIG. 17 is a side plane view of the puck body of the alternate embodiment puck assembly.
Figure 18:
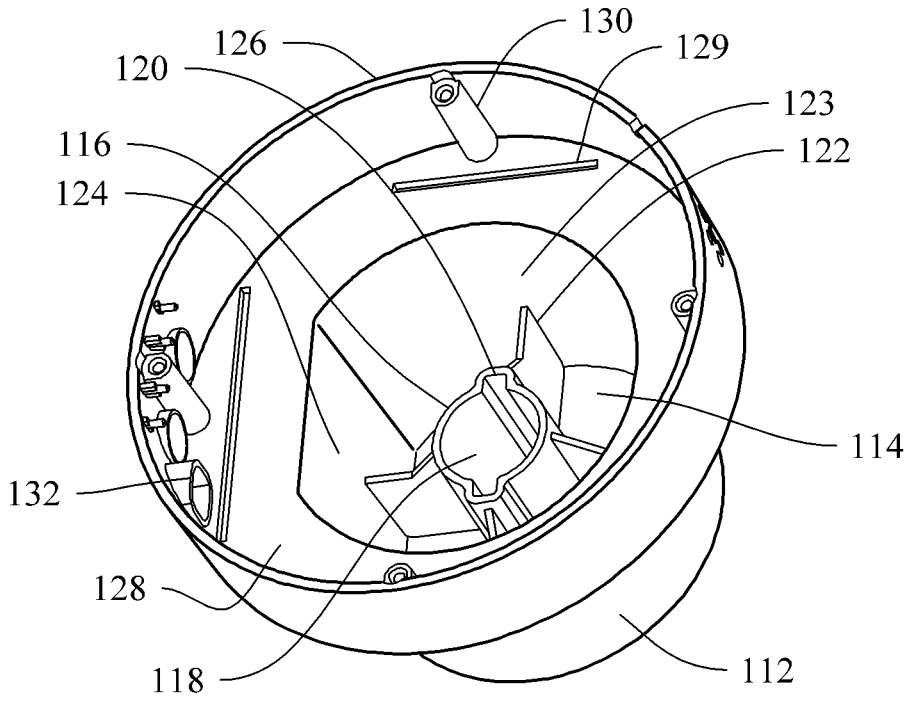
FIG. 18 is a bottom perspective view of the puck body of the alternate embodiment puck assembly.

Referring to FIGS. 17 and 18, the puck body 110 or part thereof is receivable and securable in the candle holder interior chamber 98, thereby removably attached the puck body to the candle holder 92. The puck body 110 includes an insert section 112, a base section 126 and a flange or ledge 128 between the insert section 112 and the base section 126.

The insert section 112 can be substantially cylindrical with an outwardly tapering shape from a top wall 114. The insert section 112 can have a substantially flat or planar side 124, and can have a configuration, shape and/or provide similar to that of the candle holder 92. The dimensions of the insert section 112 are smaller than the candle holder 92 so as to be receivable in the candle holder interior chamber 98.

A first section of an exterior of the insert section 112 can include a first notch 115 defined therein or there through, and configured to receive at least one of the first ridges 104 of the candle holder 92. A second notch 125 can be defined in or through the planar side 124 of the insert section 112, and is configured to receive at least one of the second ridges 108 of the candle holder 92.

Figure 24:
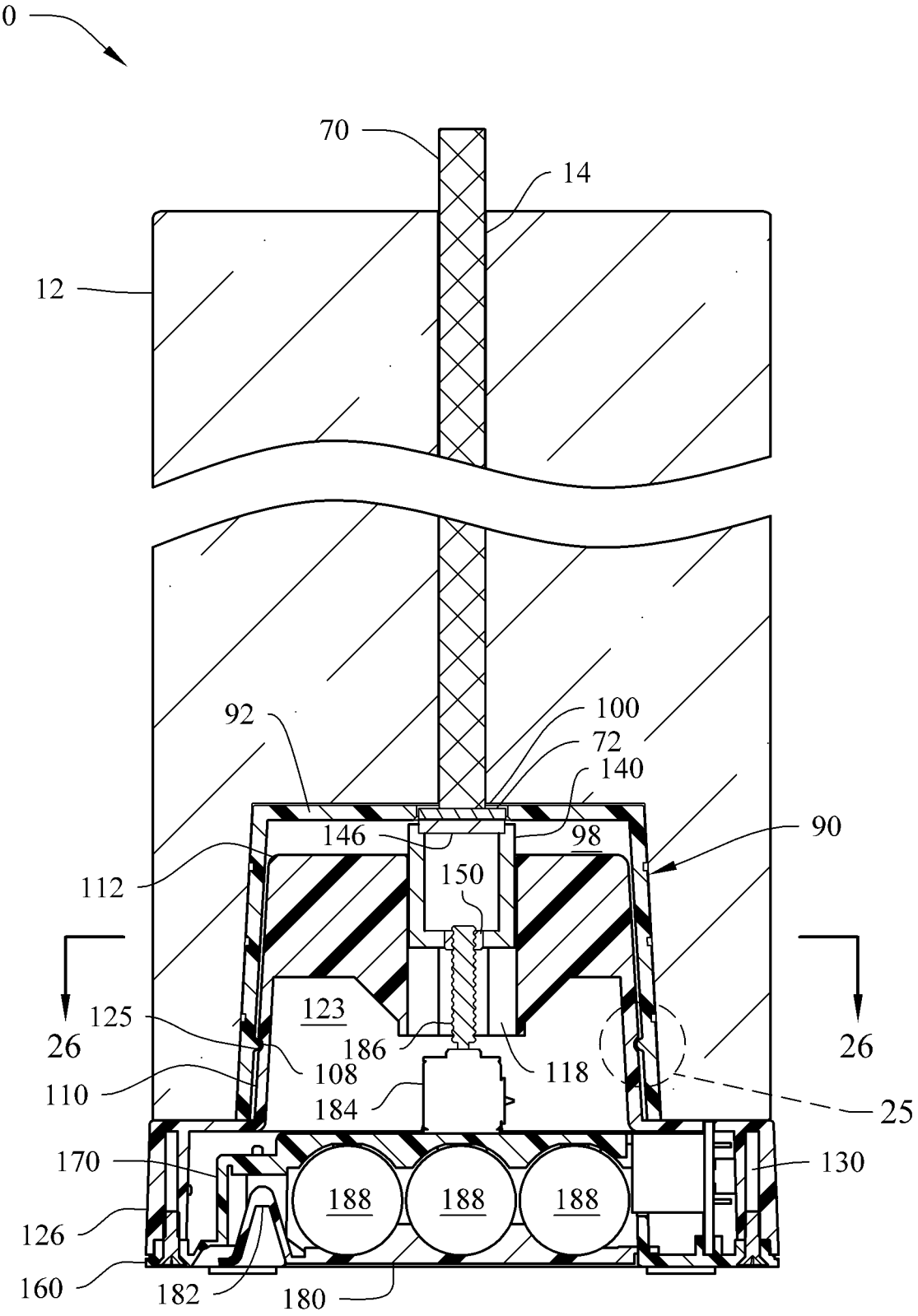
FIG. 24 is a longitudinal cross-sectional view of the flame out candle system of FIG. 14.
Figure 25:
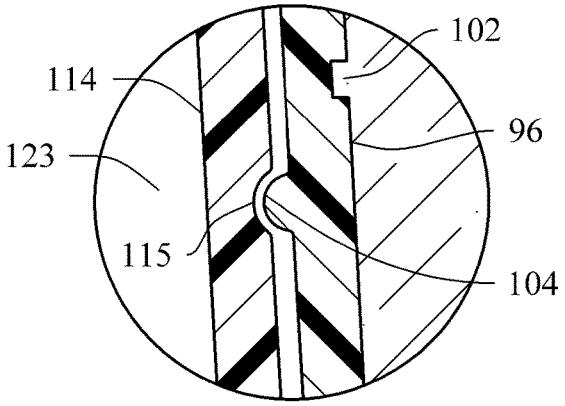
FIG. 25 is an enlarged cross-sectional view of the candle holder and the puck body connection assembly taken from line 25 in FIG. 24.
Figure 26:
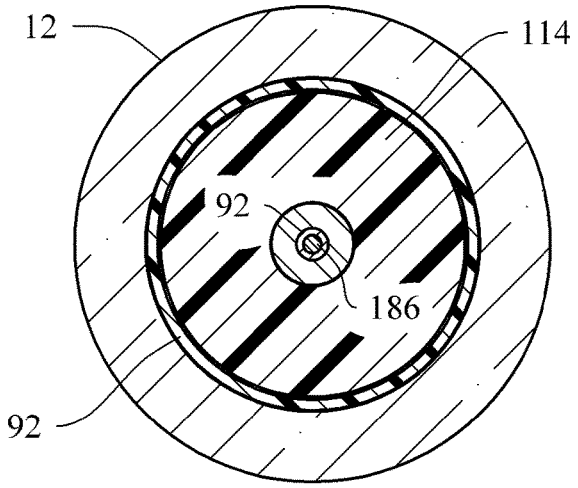
FIG. 26 is a lateral cross-sectional view of the flame out candle system taken along line 26-26 in FIG. 24.
Figure 27:
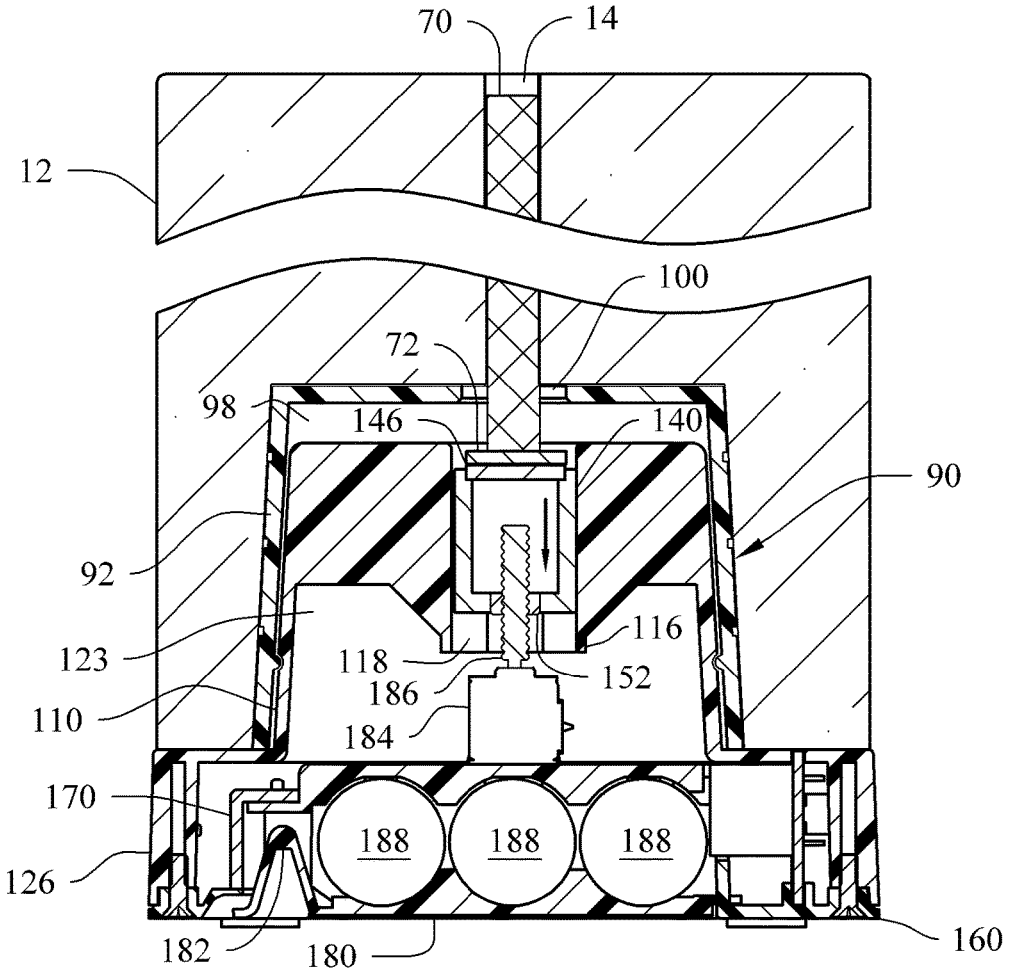
FIG. 27 is a cross-sectional view of the wick engaging member in the retracted position with the wick retracted into the candle body.

It can be appreciated that when the planar side 124 of the insert section 112 is aligned with the planar side 95 of the candle holder 92, the insert section 112 can be inserted into the candle holder interior chamber 98 so that the first and second ridges 104, 108 are received in the first and second notches 115, 125 of the insert section 112, respectively. This arrangement secures the puck body 110 to the candle holder 92, and thus to the candle body 12, as best illustrated in FIGS. 24, 25 and 27. It can be appreciated that the any combination of the first and second ridges and the first and second notches can be associated with the corresponding candle holder 92 and puck body 110.

The insert section 112 can further define an interior chamber 123 that can accommodate a guide member 116 that extends down from the top wall 114 along a longitudinal axis of the puck body 110. The guide member 116 includes a longitudinal bore 118 and one or more channels 120 in communication with bore 118, as best illustrated in FIGS. 17 and 18. The bore 118 and channels 120 can further be defined through the top wall 114. Support walls 122 can extend between the insert section 112 and the guide member 116 to provide rigid and support to the guide member 116.

The base section 126 can have a diameter or width larger than the insert section 112, thereby providing the ledge 128 that can support a bottom side of the candle body 12. The ledge 128 can include one or more ridge notches 129 defined therein or therethrough, as best illustrated in FIG. 18.

The base section 126 can have an open interior chamber 127 that is in communication with the interior chamber 123 of the insert section 112. One or more fastener posts 130, access ports 132, and guiding or securing structures can be included with the base section 126.

Figure 19:
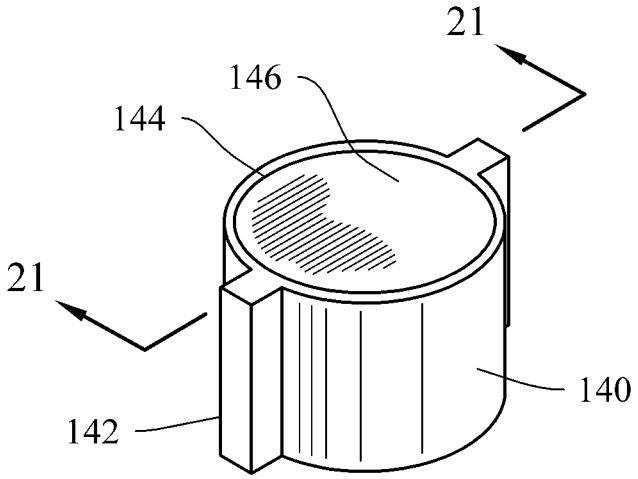
FIG. 19 is a top perspective view of the wick engaging member of the alternate embodiment puck assembly.
Figure 20:
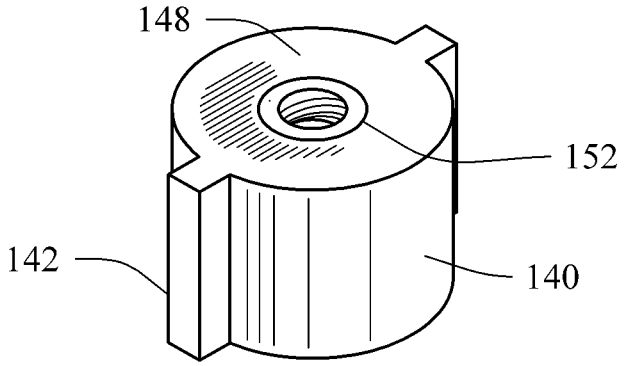
FIG. 20 is a bottom perspective view of the wick engaging member of the alternate embodiment puck assembly.
Figure 21:
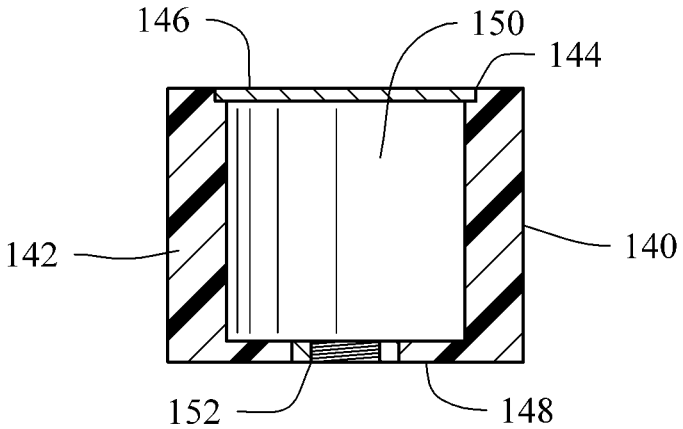
FIG. 21 is a cross-sectional view of the wick engaging member taken along line 21-21 in FIG. 19.

Referring to FIGS. 19-21, the wick engaging member 140 is configured to be slidably receivable in the bore 118 for movement therein. The wick engaging member 140 includes one or more guides 142 extending out therefrom that are configured to slidably receive in the channels 120, respectively. It can be appreciated that the configuration of the wick engaging member 140 and the guides 142 correspond to that of the bore 118 and the channels 120.

A top side or edge 144 of the wick engaging member 140 can include or can receive a magnet 146. The magnet 146 is configured to engage with the wick plate 72 of the wick 70, so that any movement of the wick engaging member 140 is translated to the wick 70. It can be appreciated that any other removable engagement structure or means can be utilized in place of the magnet 146 and wick plate 72 to achieve a removable connections therebetween.

A bottom side or wall 148 of the wick engaging member 140 can include or receive a threaded member 152 featuring a threaded bore defined therethrough that is in communication with an interior chamber 150 of the wick engaging member 140. It can be appreciated that the threaded member 152 does not have to be a separate member secured to the bottom wall 148, but can alternatively be a threaded bored defined through the bottom wall 148.

Figure 22:
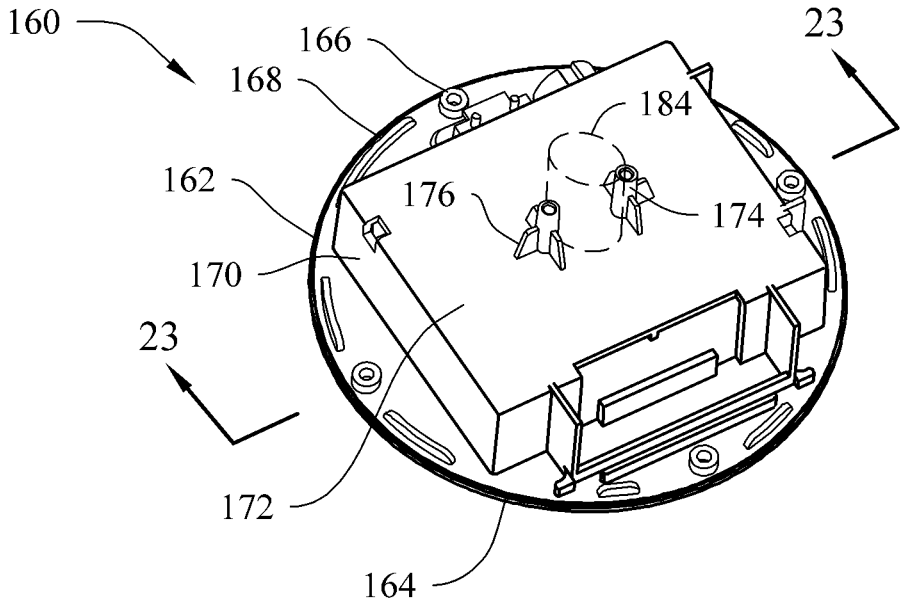
FIG. 22 is a top perspective view of the base assembly of the alternate embodiment puck assembly.
Figure 23:
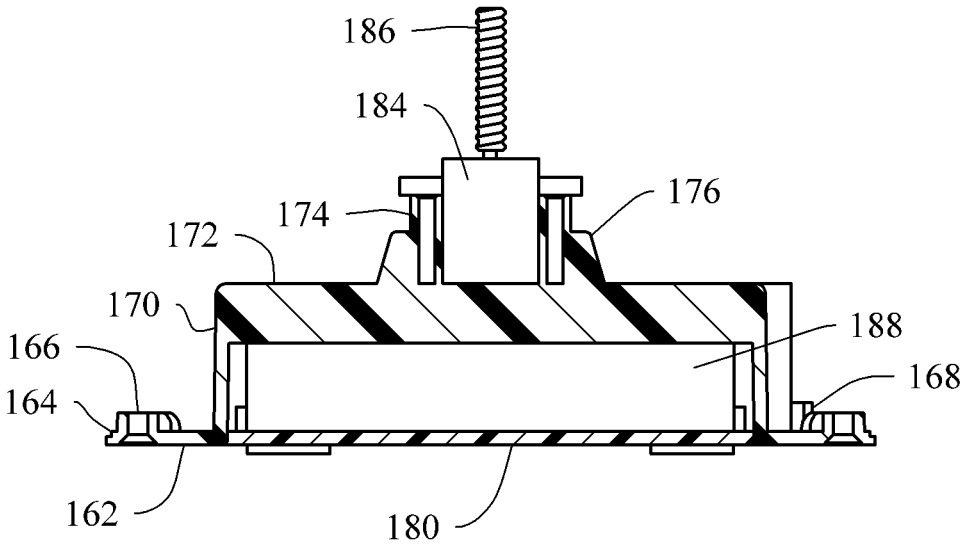
FIG. 23 is a cross-sectional view of the base assembly taken along line 23-23 in FIG. 22.

Referring to FIGS. 22 and 23, the puck base assembly 160 can be received in the open interior chamber 127 of the base section 126 and even the interior chamber 123 if needed.

Further, the puck base assembly 160 can be secured to the base section 126 by way of fasteners engageable with the fastener posts 130.

The puck base assembly 160 can include base 162 featuring a peripheral edge 164, one or more fastener members 166 and one or more guide ridges 168. The peripheral edge 164 corresponds and engages with a bottom edge of the base section 126. The one or more fastener members 166 are alignable with the fastener posts 130 when the puck base assembly 160 is assembled with the puck body 110. A fastener, as best illustrated in FIGS. 24 and 27, can be utilized with the fastener members 166 and the fastener posts 130. Further, the guide ridges 168 are extend from the base 162 in a configuration and number that corresponds with the ridge notches 129 of the ledge 128. When assembled, the guide ridges 168 are received in the ridge notches 129, thereby guiding the puck base assembly 160 in alignment with the base section 126, and further prohibits rotation of the puck base assembly 160 while assembled with the puck body 110.

A motor mount section 170 extends from the base 162 so as to be receivable in the open interior chamber 127 of the base section 126 when the puck base assembly 160 is assembled to the base section 126. A top wall 172 of the motor mount section 170 includes motor mounts 174 configured in a spaced apart relationship. Each of the motor mounts 174 can include reinforcing members 176 to provide support and rigidity to the motor mounts 174.

A motor 184 can be located between and secured to the motor mounts 174, with a power screw 186 operatively engageable with a shaft of the motor 184.

An interior of the motor mount section 170 can be configured to include batteries 188, and any other electronical components necessary for operation of the present technology.

A base panel 180 can be removably and securely associated with the base 162 to allow access to the interior of the motor mount section 170. As best illustrated in FIGS. 24 and 27, one edge of the base panel 180 can be pivotably associated with a first side of the base 162 that defines the interior of the motor mount section 170, with a second sedge of the base panel 180 can include a biased latch 182 that is engageable with a second side of the base 162. The latch 182 is configured to lock the base panel 180 in a closed position, while allowing a user to operate the latch 182 to unlock the base panel 180 and permit the base panel 180 to be pivoted open or removed.

The assembled flame out candle system 10 with the alternate puck assembly 90 is best illustrated in FIGS. 24-27. When assembled, it can be appreciated that the candle holder 92 is retained in the candle cavity 16 so that wick 70 passes through the opening 100 for travel through the wick bore 14, thereby allow for a section of the wick 70 to be exposed out of the candle body 12 for use or withdrawn into the wick bore 14 for extinguishing.

The puck body 110 can be assembled to the candle holder 92 by inserting the insert section 112 into the interior chamber 98 with the planar sides 95, 124 of the candle holder 92 and the puck body 110 aligned. Continued insertion of the insert section 112 will engage the first and second ridges 104, 108 with their corresponding first and second notches 115, 125, respectively, thereby locking the puck body 110 to the candle holder 92, as best illustrated in FIG. 25. It can be appreciated that the first and second ridges 104, 108 and the first and second notches 115, 125 are corresponding engageable members.

The wick engaging member 140 can then be inserted into the bore 118 of the guide member 116 so that the magnet 146 is engageable with the wick plate 72.

The puck base assembly 160 can be secured to the base section 126 of the puck body 110 so that the power screw 186 is received in the bore 118 and threadably engaged with the threaded member 152. It can be appreciated that the wick engaging member 140 can be assembled to the power screw 186 prior to insertion into the bore 118.

During operation as best illustrated in FIG. 27, the motor 184 can be operated to rotate the power screw 186 in either direction, which than translates into linear movement of the wick engaging member 140 within the bore 118 of the guide member 116. This linear movement of the wick engaging member 140 results in linear movement of the wick 70 by way of the magnetic engagement between the magnet 146 and the wick plate 72.

If an extinguishing operation is required, then the motor 184 can be operated in an appropriate direction so that the power screw 186 rotates in a manner to bring the wick engaging member 140 in a direction that would move the wick 70 into the candle body 12.

It can be appreciated that the modular and removably configuration of the wick 70, the candle holder 92, the puck body 110, the wick engaging member 140 and the puck base assembly 160 allow easy assembly and/or reuse of the puck assembly 90 in other candles.

A computer or controller system 200 (see FIG. 28) can be included with the puck assembly 90 and can be associated with the base assembly 160 in operable communication with the battery 188 and the motor 184. The computer or controller system 200 can include and/or be in communication with a variety electrical components, sensors, controllers, and the like. For example, the computer or controller system 200 can include a printed circuit board (PCB) featuring a timer and/or an angle or tile sensor 208 configured to detect or determine a tilting or tipping orientation of the candle body 12 or a wireless, internet or Bluetooth interface.

FIG. 28 is a diagrammatic representation of the computer or controller system 200 that is utilizable or implementable with the present technology and/or any peripheral component of the present technology. The computer or controller system 200 can be part of an example machine, which is an example of one or more of the computers referred to herein and, within which a set of instructions for causing the machine to perform any one or more of the methodologies discussed herein may be executed. In various example embodiments, the machine operates as a standalone device or may be connected (e.g., networked) to other machines. In a networked deployment, the machine may operate in the capacity of a server or a client machine in a server-client network environment, or as a peer machine in a peer-to-peer (or distributed) network environment. The machine may be a personal computer (PC), a tablet PC, a set-top box (STB), a personal digital assistant (PDA), a cellular telephone, a portable music player (e.g., a portable hard drive audio device such as an Moving Picture Experts Group Audio Layer 3 (MP3) player), a web appliance, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer or controller system 200 includes a processor or multiple processors 202 (e.g., a central processing unit (CPU), a graphics processing unit (GPU), or both), and a memory 206, which communicate with each other via a bus 232. The computer or controller system 200 may further include or be in operable communication with the audio device or input (e.g., a voice recognition or biometric verification unit, microphone) 212, the battery units 26, a video display 216 (e.g., a liquid crystal display (LCD), touch sensitive display), charging ports 220, the lights 228, and/or activation input devices 230 (e.g., a keyboard, keypad, touchpad, touch display, buttons, switches). The computer or controller system 200 may also include additional sensors and/or inputs 218 (e.g., a motion sensor, a heat sensor, a distance sensor), a drive unit 222 (also referred to as disk drive unit), a signal generation device 226 (e.g., a speaker), the tilt sensor 208, a wireless or infrared (IR) receiver 210, and a network interface device 214. The computer or controller system 200 may further include a data encryption module (not shown) to encrypt data. The drive unit 222 includes a computer or machine-readable medium 224 on which is stored one or more sets of instructions and data structures (e.g., instructions 204) embodying or utilizing any one or more of the methodologies or functions described herein. The instructions 204 may also reside, completely or at least partially, within the memory 206 and/or within the processors 202 during execution thereof by the computer or controller system 200. The memory 206 and the processors 202 may also constitute machine-readable media.

The instructions 204 may further be transmitted or received over a network via the network interface device 214 utilizing any one of a number of well-known transfer protocols (e.g., Hyper Text Transfer Protocol (HTTP)). While the machine-readable medium 224 is shown in an example embodiment to be a single medium, the term "computer-readable medium" should be taken to include a single medium or multiple media (e.g., a centralized or distributed database and/or associated caches and servers) that store the one or more sets of instructions. The term "computer-readable medium" shall also be taken to include any medium that is capable of storing, encoding, or carrying a set of instructions for execution by the machine and that causes the machine to perform any one or more of the methodologies of the present application, or that is capable of storing, encoding, or carrying data structures utilized by or associated with such a set of instructions. The term "computer-readable medium" shall accordingly be taken to include, but not be limited to, solid-state memories, optical and magnetic media, and carrier wave signals. Such media may also include, without limitation, hard disks, floppy disks, flash memory cards, digital video disks, random access memory (RAM), read only memory (ROM), and the like. The example embodiments described herein may be implemented in an operating environment comprising software installed on a computer, in hardware, or in a combination of software and hardware.

An example machine system of the present technology including the computer or controller system 200 in combinational and/or operational use with components of the present technology. In the exemplary, any or all of above described components can include a processor 202, memory 206, a network interface device 214, a display 216, an input device(s) 218, and/or drive unit 222.

The computer or controller system 200 and/or any of the above electronic components can be housed in any one of or any combination of the puck assembly 20, 20', 90 and the puck base assembly 84, 160.

It can be appreciated the computer or controller system 200 can include or be in communication additional components such as, but not limited to, a flameout, heat or temperature sensor that is configured or configurable to determine excess flame or heat from the wick 70.

It can be appreciated that any one of or any combination of the puck assembly of the present technology can be designed with a mechanical system to reel in the wick 70 at preset time intervals or upon a preset tiling angle of the candle body 12. Preset time intervals can include a TEST mode, one hour, two hours, three hour and four hour settings.

The TEST mode can be used to enable a user to validate the puck assembly is functioning correctly. The TEST mode can allow the candle body 12 to burn for a short predetermined amount of time, then reel in the wick 70 to extinguish the flame, and then the puck assembly will reverse the wick 70 pushing the wick 70 back up allowing it to extend approximately one quarter inch above the surface of the melted candle wax, allowing the wick 70 to be relighted.

Any one of or any combination of the puck assembly can include a switch allowing the user to set a length of time the candle body 12 will burn. Once the preset time is reached, the puck assembly can then automatically reel in the wick 70 far enough to extinguish the flame and then, while the wax is still liquid, it will reverse the wick 70 so it extends one quarter inch above the surface of the melted wax, thereby allowing the wick 70 to be relighted multiple times until the candle wax is exhausted. In the exemplary, the timer function can be overwritten by vice command, for example by speaking "Flame Out", which will extinguish the candle on demand.

Any one of or any combination of the puck assembly and accompanying candle body 12 can be designed in a variety of sizes and shapes. The puck assembly can be battery operated and designed to be reusable on candles designed for each size and shape puck assembly.

Each candle design and its accompanying puck assembly can be sold together as a unit/kit or as separate products. It can be appreciated that any one of or any combination of the puck assembly can be reused on replacement candles with a SKU number for each puck assembly design.

It can be further appreciated that the wick 70 can be replaceable wicks a consumer can buy which burn in various colors, patterns and/or effects. The wick 70 can be easily removed and replaced by a user, allowing the user to choose a wick that burns their desired flame color, pattern and/or effect. These wicks can have a material threaded or associated therein allowing the wick to burn various colors, patterns and/or effects. The material can be, but not limited to, a fine metal filament. The replaceable wicks can be sold as an add on product the consumer can purchase if desired.

The size and/or number of teeth of the drive gear 44, spur gears 46, 50, pinion gears 54, 56 and/or rack gear 74 can be configured to provide specific travel distance of the wick 70.

In the exemplary, the present technology can include in part any one of or any combination of following advantageous features such as, but not limited to: side locks 30 and lock bars 34 to secure any one of or any combination of the puck assembly 20, 20', 90 in the candle body 12; spur and pinion gears to transfer linear motion to the wick 70 and to increase torque to a target range; the metal washer 80 to protect any one of or any combination of the puck assembly 20, 20', 90 from being damaged; the wick stroke can be around 10 mm; 360 degree tilting sensor 208 that can be integrated with the PCB of the computer or controller system 200; and a tolerance of the wick bore 14 for movement of the wick 70 within the candle body 12 can be 0.6 mm.

In the exemplary, a microphone 212 can be utilized in communication with the processor 202 to receive voice commands to operate functions of the present technology. For example, a user can speak a voice command such as, but not limited to, "retract wick" or "flame out" and the microphone 212 can detect the command and send a signal/data to the processor 202 for processing. The processor 202 can then activate the motor 40, 184 appropriately based on the instructions 204 associated with the voice command.

In an alternative, the wick 70 can be reeled into any one of or any combination of the puck assembly 20, 20', 90, and after which can be removed by way of activating a puck removal switch that disengages a directional reel of the motor 40, 184 allowing the puck assembly to be in a free wheel state. This allows any one of or any combination of the puck assembly 20, 20', 90 to be removed from the candle body 12 without damaging the reel, any of the gears, power screws, threads or motor 40, 184 within the puck assembly.

After the puck assembly is removed from the candle body 12 with the wick 70 may still be attached to the puck assembly. A wick release switch can be activated releasing a quarter inch portion of the wick 70 which was first activated, thereby allowing the puck assembly 20 to be reused on a different candle.

Any one of or any combination of the puck assembly 20, 20', 90 can be designed with a safety feature which will automatically reel or retract in the wick 70 and extinguish the flame if the candle is tilted a predetermined or preset number of degrees (tilt angle degrees), thereby reducing the possibility of a fire in the case the candle body 12 is knocked over by a child, pet or some other cause. After this automatic retraction and preset time, the motor 40, 184 can then reverse so the wick 70 extends back out the wick bore 14 and the candle can be reused. In addition if the battery voltage drops to a low level an auditable signal can be activated to signal low battery life to the user, and shortly thereafter the motor 40, 184 can be activated to self-extinguish the wick, accordingly, overriding all previous settings before battery life is terminated. As mentioned above, this safety feature may include a mercury type switch or the like that is in communication with the motor 40, 184 or the computer or controller system 200.

Any one of or any combination of the puck assembly 20, 20', 90 and candle body 12 can be adapted for use with candles contained in a glass jar, long narrow tapered candles, multiple wick candles, multiple color and scented candles and virtually all candle shapes and sizes.

In use, it can now be understood that a user can preset a time duration for automatic extinguishing of the wick flame, or the user can manually activate the motor by operation of a button, or the motor can be automatically operated upon exceeding a preset tilt angle of the candle, or by receiving a signal from a remote or wireless device.

It can be appreciated that to assemble one embodiment of the present technology the user can first insert the assembled rack gear 74 and wick plate 72 into the top cavity 65 while in the unlocked position. The user can continue to push the wick plate 72 so that the teeth 76 of the rack gear 74 are engaged with the teeth of the first and second pinion gears 54, 56, thereby placing the preset technology into the locked position.

With the wick 70 attached to the wick plate 72, the user can then thread the wick 70 into the wick bore 14 of the candle and insert the puck assembly into the bottom cavity 16 of the candle body 12. The lock bars 34 can be rotated or slide into an engaging position so that ends of the lock bars 34 extend into the candle body 12 to secure the puck assembly with the candle body 12. After which, the preset technology is now capable of being operated.

According to one aspect, the present technology can include a flame out candle system 10 for retracting a wick 70 into a candle body 12. The flame out candle system 10 can include a puck assembly 20, 20', 90 associated with the candle body 12. The puck assembly 20, 20', 90 can include a motor 40, 184 operatively engageable with a wick engaging member 74, 140 that is operatively engageable with the wick 70 to provide movement of the wick within the candle body 12.

According to another aspect, the present technology can include a flame out candle system 10 including a puck body 60, 110, a wick engaging member 74, 140 and a puck base assembly 22, 160. The puck body 60, 110 can be receivable in a cavity 16 defined in a candle 12. The puck body 60, 110 can include a guide member 64, 116, and a bore 65, 118 defined through the guide member. The wick engaging member 74, 140 can be slidably receivable in the bore 65, 118 of the guide member 64, 116. The wick engaging member 74, 140 can be operatively engageable with a wick 70. The puck base assembly 22, 160 can be attachable to the puck body 60, 110. The puck base assembly 22, 160 can include a motor 40, 184 operatively engageable with the wick engaging member 74, 140 to provide linear movement of the wick engaging member 74, 140 that provides movement of the wick 70 within the candle 12.

According to still another aspect, the present technology can include a flame out candle system 10 that can include a candle 12, a wick 70, a puck body 60, 110, a wick engaging member 74, 140, a puck base assembly 22, 160, a motor 40, 184 and a computer or controller system 200. The candle 12 can include a wick bore 14 defined along a longitudinal axis of the candle, and a bottom cavity 16 defined in a bottom section of the candle and in communication with the wick bore. The wick 70 can be configured to be slidably receivable through the wick bore 14. A wick plate 72 can be associated with the wick 70. The puck body 60, 110 can be receivable in the bottom cavity 16 of the candle 12. The puck body 60, 110 can include a guide member 64, 116, and a bore 65, 118 defined through the guide member 64, 116. The wick engaging member 74, 140 can be slidably receivable in the bore 65, 118 of the guide member 64, 116. The wick engaging member 74, 140 can be operatively engageable with the wick plate 72. The puck base assembly 22, 160 can be attachable to the puck body 60, 110. The puck base assembly 22, 160 can be configured to support a motor 40, 184 that can be operatively engageable with the wick engaging member 74, 140 to provide linear movement of the wick engaging member 74, 140 that provides movement of the wick 70 within the candle 12. The computer or controller system 200 can be configured or configurable to control the motor 40, 184 based on one of or any combination of a time signal, an activation signal, a sensor signal, a voice command, a wireless activation signal, and a networked activation signal.

According to yet another aspect, the present technology can include a method of using a flame out candle system 10 to extinguish a wick flame. The method can include the steps of controlling a motor 40, 184 to operatively drive a wick engaging member 74, 140 of a puck assembly 20, 20', 90 associated with the candle body 12. The wick engaging member 74, 140 being operatively engageable with a wick 70 to provide movement of the wick within the candle body 12.

According to yet another aspect, the present technology can include a flame out candle system 10 including a first pinion gear 54, a second pinion gear 56, a motor 40, a rack gear 74 and a wick 70. The second pinion gear 56 can be spaced apart from the first pinion gear 54 to define a gap therebetween. The motor 40 can be operatively configured to drive the first pinion gear 54 and the second pinion gear 56 so that the first pinion gear 54 and the second pinion gear 56 rotate in opposite directions. The rack gear 74 can be receivable in the gap and can be engageable with the first pinion gear 54 and the second pinion gear 56 so that rotation of the first pinion gear 54 and the second pinion gear 56 provides linear movement of the rack gear 74. The wick 70 can be associated with the rack gear 74 for movement therewith through a wick bore 14 defined in a candle or candle body 12.

According to yet still another aspect, the present technology can include a flame out candle system 10 including a candle or candle body 12, a wick assembly, and a puck assembly 20, 20'. The candle body 12 can include a wick bore 14 defined along a longitudinal axis of the candle body 12, and a bottom cavity 16 defined in a bottom section of the candle body 12 and in communication with the wick bore 14. The wick assembly can include a wick 70, a wick plate 72 and a rack gear 74. The wick 70 can be configured to be slidably receivable through the wick bore 14. The wick plate 72 can be receivable in the bottom cavity 16. The rack gear 74 can be attached to the wick plate 72. The puck assembly can be receivable in the bottom cavity 16 of the candle body 12. The puck assembly can include a first spur gear 46 and a first pinion gear 54 both fixed to a first shaft 48. A second spur gear 50 and a second pinion gear 56 both fixed to a second shaft 52. The second spur gear 50 can be engageable with the first spur gear 46. The second pinion gear 56 can be spaced apart from the first pinion gear 54 to define a gap therebetween configured to receive the rack gear 74. A motor 40 can be operatively configured to drive the first spur gear 46. A computer or controller system 200 can be configured or configurable to control the motor 40 based on one of or any combination of a time signal, an activation signal and a sensor signal. The rack gear 74 can be engageable with the first pinion gear 54 and the second pinion gear 56 so that rotation of the first pinion gear 54 and the second pinion gear 56 provides linear movement of the rack gear 74.

According to yet another aspect, the present technology can include a method of using a flame out candle system 10 to extinguish a wick flame. The method can include the steps of controlling a motor 40 to operatively drive a first pinion gear 54 and a second pinion gear 56 to linearly move a rack gear 74 engageably positioned therebetween. The rack gear 74 can be configured to provide linear movement to a wick 70 that can be slidably received through a wick bore 14 defined through a candle or candle body 12.

In some or all embodiments, the puck assembly 20, 20', 90 can further include a puck body 60, 110 receivable in a cavity 16 defined in the candle 12, and a puck base assembly 22, 160 attachable to the puck body and configured to support the motor 40, 184.

In some or all embodiments, the motor 40, 184 can be operatively associated with one selected from the group consisting of gears 46, 50, 54, 56, and a power screw 186.

In some or all embodiments, the wick engaging member 74, 140 can be configured to be driven by the motor 40, 184 and to provide linear movement to the wick 70.

In some or all embodiments, the wick engaging member 140 can include a threaded member 152 that is operatively engaged with a power screw 186 that is operatively driven by the motor 184.

In some or all embodiments, the wick engaging member 74, 140 can be slidably received in a bore 65, 118 defined through a guide member 64, 116 of the puck body 60, 110.

In some or all embodiments, the wick engaging member 140 can further include one or more guides 142 extending out therefrom that are each configured to be slidably received in a channel 120 defined in the guide member 116 and in communication with the bore 118.

In some or all embodiments, the wick engaging member can include a magnetic that is operatively engageable with a wick plate of the wick.

In some or all embodiments, the puck assembly 90 can further include a candle holder 92 that is receivable in the cavity 16 of the candle 12 and that is configured to receive an insert section 112 of the puck body 110 with a base section 126 of the puck body supporting a bottom portion of the candle 12.

In some or all embodiments, the candle holder 92 and the insert section 112 can include corresponding engageable elements 104, 108, 115, 125 configured to secure the puck body 110 to the candle holder 92 when the insert section 112 is inserted a predetermined distance into the candle holder 92.

Some or all embodiments of the present technology can include a first spur gear 46 operatively engageable with a drive gear 44 of the motor 40. The first spur gear 46 can be fixed to a first shaft 48 that is fixed to the first pinion gear 54.

Some or all embodiments of the present technology can include a second spur gear 50 operatively engageable with the first spur gear 46. The second spur gear 50 can be fixed to a second shaft 52 that is fixed to the second pinion gear 56.

In some or all embodiments, the first pinion gear 54 and the second pinion gear 56 can each include a ledge 55, 57 extending out from a peripheral edge therefrom, respectively. The ledge 55 of the first pinion gear 54 and the ledge 57 of the second pinion gear 56 can be configured to contact the rack gear 74 in an unlocked position.

Some or all embodiments of the present technology can include a wick plate 72 attached to the wick 70 and to the rack gear 74.

Some or all embodiments of the present technology can include a puck assembly 20 that can include a bottom cover 22 and a top cover 60. The bottom cover 22 can be configured to support the motor 40, the first pinion gear 54 and the second pinion gear 56. The top cover 60 can be attachable to the bottom cover 22 to enclose the motor 40, the first pinion gear 54 and the second pinion gear 56.

In some or all embodiments, the bottom cover 22 can further include one or more side locks 30 extending from the bottom cover 22.

In some or all embodiments, the top cover 60 can include one or more side lock notches 62 configured to receive one or more of the side locks 30 therein when the top cover 60 and the bottom cover 22 are assembled.

Some or all embodiments of the present technology can include a lock bar 34 configured to be receivable in a slot 32 defined in the side locks 30. The lock bar 34 can be configured to extend exterior of the puck assembly 20 for insertion in to the candle body 12.

In some or all embodiments, the puck assembly 20 can be configured to be securably received in a bottom cavity 16 defined in a bottom section of the candle body 12.

In some or all embodiments, the top cover 60 can include a recessed section 64 defining a top cavity 65 configured to slidably receive the wick plate 72. A bore 63 can be defined through the recessed section 64 configured to slidably receive the rack gear 74.

Some or all embodiments of the present technology can include a washer 80 positionable between a top wall of the top cover 60 and a cavity top wall of the candle body 12 that defines the bottom cavity 16.

In some or all embodiments, the puck assembly 20 can further include a U-shaped drive supporting structure 36 configured to rotatably support the first shaft 48 and the second shaft 52, and the first pinion gear 54 and the second pinion gear 56 between parallel side walls that in part defines the U-shaped drive supporting structure 36, with the first spur gear 43 and the second spur gear 50 being located exterior of the parallel side walls.

Some or all embodiments of the present technology can include a computer or controller system 200 configured or configurable to control the motor 40, 184 based on any one of or any combination of a time signal, an activation signal and a sensor signal.

In some or all embodiments, the computer or controller system 200 can be configured or configurable to control the motor 40 based on a sensor selected from the group consisting of a tilt or angle sensor 208, and a heat sensor 218.

Some or all embodiments of the present technology can include a puck base 84 attachable to the puck assembly 20' and configured to be in electrical communication with electrical components of the puck assembly 20'.

In some or all embodiments, the puck base 84 can include a metal washer 80 fitted to a top side of the puck base 84 that is in contact with a bottom side of the candle body 12.

In some or all embodiments, the puck base 84 can have a diameter or width greater than a diameter or width of the candle body 12.

While embodiments of the flame out candle system and method have been described in detail, it should be apparent that modifications and variations thereto are possible, all of which fall within the true spirit and scope of the present technology. With respect to the above description then, it is to be realized that the optimum dimensional relationships for the parts of the present technology, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present technology. For example, any suitable sturdy material may be used instead of the above-described. And although retracting a wick into a candle have been described, it should be appreciated that the flame out candle system and method herein described is also suitable for retracting a wick of a fuel burning lamp of stove.

Therefore, the foregoing is considered as illustrative only of the principles of the present technology. Further, since numerous modifications and changes will readily occur to those skilled in the art, it is not desired to limit the present technology to the exact construction and operation shown and described, and accordingly, all suitable modifications and equivalents may be resorted to, falling within the scope of the present technology.

What is claimed as being new and desired to be protected by Letters Patent of the United States is as follows:

1. A flame out candle system for moving a wick into a wax candle body, the flame out candle system comprising a puck assembly associated with the wax candle body, the puck assembly including a motor operatively engageable with a wick engaging member that is operatively engageable with the wick to provide movement of the wick within a wick bore defined along a longitudinal axis of the wax candle body.

2. The flame out candle system according to claim 1, wherein the puck assembly further comprising:

a puck body receivable in a cavity defined in the wax candle body; and a base assembly attachable to the puck body and configured to support the motor.

3. The flame out candle system according to claim 2, wherein the motor is operatively associated with one selected from the group consisting of a gear, and a power screw.

4. The flame out candle system according to claim 2, wherein the wick engaging member is configured to be driven by the motor and to provide linear movement to the wick within the wick bore.

5. The flame out candle system according to claim 4, wherein the wick engaging member includes a thread member that is operatively engaged with a power screw that is operatively driven by the motor.

6. The flame out candle system according to claim 5, wherein the wick engaging member is slidably received in a bore defined through a guide member of the puck body.

7. The flame out candle system according to claim 6, wherein the wick engaging member further includes one or more guides extending out therefrom that are each configured to be slidably received in a channel defined in the guide member and in communication with the bore.

8. The flame out candle system according to claim 7, wherein the wick engaging member includes a magnetic that is operatively engageable with a wick plate of the wick.

9. The flame out candle system according to claim 2, wherein the puck assembly further comprises a candle holder that is receivable in the cavity of the wax candle body and that is configured to receive an insert section of the puck body with a base section of the puck body supporting a bottom portion of the wax candle body.

10. The flame out candle system according to claim 9, wherein the candle holder and the insert section include corresponding engageable elements configured to secure the puck body to the candle holder when the insert section is inserted a predetermined distance into the candle holder.

11. The flame out candle system according to claim 1 further comprising a computer or controller system configured or configurable to control the motor based on any one of or any combination of a time signal, an activation signal and a sensor signal.

12. The flame out candle system according to claim 11, wherein the computer or controller system being configured or configurable to control the motor based on a sensor selected from the group consisting of a tilt sensor, an angle sensor, and a heat sensor.

13. A flame out candle system comprising:

a puck body receivable in a cavity defined in a wax candle body, the puck body including a guide member, and a bore defined through the guide member;

a wick engaging member slidably receivable in the bore of the guide member, the wick engaging member being operatively engageable with a wick; and a base assembly attachable to the puck body, the base assembly including a motor operatively engageable with the wick engaging member to provide linear movement of the wick engaging member that provides movement of the wick within a wick bore defined along a longitudinal axis of the wax candle body.

14. The flame out candle system according to claim 13, wherein the wick engaging member includes a thread member that is operatively engaged with a power screw that is operatively driven by the motor.

15. The flame out candle system according to claim 14, wherein the wick engaging member further includes one or more guides extending out therefrom that are each configured to be slidably received in a channel defined in the guide member and in communication with the bore.

16. The flame out candle system according to claim 15, wherein the wick engaging member includes a magnetic that is operatively engageable with a wick plate of the wick.

17. The flame out candle system according to claim 13 further comprises a candle holder that is receivable in the cavity of the wax candle body and that is configured to receive an insert section of the puck body with a base section of the puck body supporting a bottom portion of the wax candle body.

18. The flame out candle system according to claim 13 further comprising a computer or controller system configured or configurable to control the motor based on any one of or any combination of a time signal, an activation signal and a sensor signal, wherein the computer or controller system being configured or configurable to control the motor based on a sensor selected from the group consisting of a tilt sensor, an angle sensor, and a heat sensor.

19. A flame out candle system comprising:

a wax candle body including a wick bore defined along a longitudinal axis of the wax candle body, and a bottom cavity defined in a bottom section of the wax candle body and in communication with the wick bore;

a wick configured to be slidably receivable through the wick bore, the wick can include a wick plate associated with the wick;

a puck body receivable in the bottom cavity of the wax candle body, the puck body including a guide member, and a bore defined through the guide member;

a wick engaging member slidably receivable in the bore of the guide member, the wick engaging member being operatively engageable with the wick plate;

a base assembly attachable to the puck body, the base assembly being configured to support a motor, the motor being operatively engageable with the wick engaging member to provide linear movement of the wick engaging member that provides movement of the wick within the wax candle body; and a computer or controller system configured or configurable to control the motor based on one of or any combination of a time signal, an activation signal, a sensor signal, a voice command, a wireless activation signal, and a networked activation signal.

20. The flame out candle system according to claim 19 further comprises a candle holder that is receivable in the bottom cavity of the wax candle body and that is configured to receive an insert section of the puck body with a base section of the puck body supporting a bottom portion of the wax candle body, and wherein the wick engaging member includes a thread member that is operatively engaged with a power screw that is operatively driven by the motor.

* * * * *